US007216955B2

(12) United States Patent
Niekawa

(10) Patent No.: US 7,216,955 B2
(45) Date of Patent: May 15, 2007

(54) INKJET PRINTER AND RECORDING HEADS UNIT

(75) Inventor: Yukihiro Niekawa, Hachioji (JP)

(73) Assignee: Konica Minolta Holdings, Inc. (JP)

( * ) Notice: Subject to any disclaimer, the term of this patent is extended or adjusted under 35 U.S.C. 154(b) by 0 days.

(21) Appl. No.: 11/313,433

(22) Filed: Dec. 21, 2005

(65) Prior Publication Data

US 2006/0098043 A1 May 11, 2006

Related U.S. Application Data

(62) Division of application No. 10/723,274, filed on Nov. 25, 2003, now Pat. No. 7,008,042.

(30) Foreign Application Priority Data

Nov. 28, 2002 (JP) ..... 2002-345431

(51) Int. Cl.
*B41J 2/21* (2006.01)

(52) U.S. Cl. ..... 347/43; 347/41

(58) Field of Classification Search ..... 347/41, 347/43

See application file for complete search history.

(56) References Cited

U.S. PATENT DOCUMENTS

| | | | | |
|---|---|---|---|---|
| 6,003,972 | A | 12/1999 | Narushima | |
| 6,254,218 | B1 | 7/2001 | Suzuki et al. | |
| 6,315,389 | B1 | 11/2001 | Torgerson et al. | |
| 6,398,332 | B1 | 6/2002 | Silverbrook et al. | |
| 2003/0035037 | A1 * | 2/2003 | Mills et al. | 347/102 |
| 2003/0090539 | A1 * | 5/2003 | Lahut et al. | 347/43 |

* cited by examiner

*Primary Examiner*—Lamson Nguyen
(74) *Attorney, Agent, or Firm*—Cantor Colburn LLP

(57) ABSTRACT

An inkjet printer capable of inhibiting color tone change on a recording-finished image with an easy structure. The inkjet printer has: a plurality of recording heads for jetting ink having different colors from each other, wherein an image is recorded by moving the plurality of the recording heads over a recording medium conveyed along a conveyance direction, along a direction perpendicular to the conveyance direction; each recording head has a plurality of nozzles for jetting the ink as minute liquid drops; the plurality of nozzles are arrayed at intervals of predetermined number of pixels along the conveyance direction in each recording head; and each nozzle of one recording head is arranged at a position shifted from each nozzle of the other recording head along the conveyance direction so as to dispose each nozzle of the one recording head within the interval between the nozzles of the other recording head.

9 Claims, 11 Drawing Sheets

| LINE (ROW) | SCAN ORDER | | | | INK COLOR PILING ORDER |
|---|---|---|---|---|---|
| | FIRST | SECOND | THIRD | FOURTH | |
| n+8 | Y | K | C | M | Y → K → C → M |
| n+7 | M | Y | K | C | M → Y → K → C |
| n+6 | C | M | Y | K | C → M → Y → K |
| n+5 | K | C | M | Y | K → C → M → Y |
| n+4 | Y | K | C | M | Y → K → C → M |
| n+3 | M | Y | K | C | M → Y → K → C |
| n+2 | C | M | Y | K | C → M → Y → K |
| n+1 | K | C | M | Y | K → C → M → Y |
| n | Y | K | C | M | Y → K → C → M |
| n-1 | M | Y | K | C | M → Y → K → C |
| n-2 | C | M | Y | K | C → M → Y → K |
| n-3 | K | C | M | Y | K → C → M → Y |
| n-4 | Y | K | C | M | Y → K → C → M |
| n-5 | M | Y | K | C | M → Y → K → C |
| n-6 | C | M | Y | K | C → M → Y → K |
| n-7 | K | C | M | Y | K → C → M → Y |
| n-8 | Y | K | C | M | Y → K → C → M |
| n-9 | M | Y | K | C | M → Y → K → C |
| n-10 | C | M | Y | K | C → M → Y → K |
| n-11 | K | C | M | Y | K → C → M → Y |
| n-12 | Y | K | C | M | Y → K → C → M |
| n-13 | M | Y | K | C | M → Y → K → C |
| n-14 | C | M | Y | K | C → M → Y → K |
| n-15 | K | C | M | Y | K → C → M → Y |

FIG.3

| LINE (ROW) | SCAN ORDER | | | | INK COLOR PILING ORDER |
|---|---|---|---|---|---|
| | FIRST | SECOND | THIRD | FOURTH | |
| n+8 | Y | K | C | M | Y → K → C → M |
| n+7 | M | Y | K | C | M → Y → K → C |
| n+6 | C | M | Y | K | C → M → Y → K |
| n+5 | K | C | M | Y | K → C → M → Y |
| n+4 | Y | K | C | M | Y → K → C → M |
| n+3 | M | Y | K | C | M → Y → K → C |
| n+2 | C | M | Y | K | C → M → Y → K |
| n+1 | K | C | M | Y | K → C → M → Y |
| n | Y | K | C | M | Y → K → C → M |
| n-1 | M | Y | K | C | M → Y → K → C |
| n-2 | C | M | Y | K | C → M → Y → K |
| n-3 | K | C | M | Y | K → C → M → Y |
| n-4 | Y | K | C | M | Y → K → C → M |
| n-5 | M | Y | K | C | M → Y → K → C |
| n-6 | C | M | Y | K | C → M → Y → K |
| n-7 | K | C | M | Y | K → C → M → Y |
| n-8 | Y | K | C | M | Y → K → C → M |
| n-9 | M | Y | K | C | M → Y → K → C |
| n-10 | C | M | Y | K | C → M → Y → K |
| n-11 | K | C | M | Y | K → C → M → Y |
| n-12 | Y | K | C | M | Y → K → C → M |
| n-13 | M | Y | K | C | M → Y → K → C |
| n-14 | C | M | Y | K | C → M → Y → K |
| n-15 | K | C | M | Y | K → C → M → Y |

FIG. 5

| LINE (ROW) | SCAN ORDER | | | | | | | | INK COLOR PILING ORDER |
|---|---|---|---|---|---|---|---|---|---|
| | FIRST | SECOND | THIRD | FOURTH | FIFTH | SIXTH | SEVENTH | EIGHTH | |
| n+3 | | Y | | K | | C | | M | Y→K→C→M |
| n+2 | K | | C | | M | | Y | | K→C→M→Y |
| n+1 | | M | | Y | | K | | C | M→Y→K→C |
| n | Y | | K | | C | | M | | Y→K→C→M |
| n-1 | | C | | M | | Y | | K | C→M→Y→K |
| n-2 | M | | Y | | K | | C | | M→Y→K→C |
| n-3 | | K | | C | | M | | Y | K→C→M→Y |
| n-4 | C | | M | | Y | | K | | C→M→Y→K |
| n-5 | | Y | | K | | C | | M | Y→K→C→M |
| n-6 | K | | C | | M | | Y | | K→C→M→Y |
| n-7 | | M | | Y | | K | | C | M→Y→K→C |
| n-8 | Y | | K | | C | | M | | Y→K→C→M |
| n-9 | | C | | M | | Y | | K | C→M→Y→K |
| n-10 | M | | Y | | K | | C | | M→Y→K→C |

FIG. 8

| LINE(COLUMN) | | | | | | | |
|---|---|---|---|---|---|---|---|
| m-2 | m-1 | m | m+1 | m+2 | m+3 | m+4 | m+5 |
| ⋮ | ⋮ | ⋮ | ⋮ | ⋮ | ⋮ | ⋮ | ⋮ |
| C | K | Y | M | C | K | Y | M |
| K | Y | M | C | K | Y | M | C |
| Y | M | C | K | Y | M | C | K |
| M | C | K | Y | M | C | K | Y |
| ⋮ | ⋮ | ⋮ | ⋮ | ⋮ | ⋮ | ⋮ | ⋮ |
| C↓K↓Y↓M | K↓Y↓M↓C | Y↓M↓C↓K | M↓C↓K↓Y | C↓K↓Y↓M | K↓Y↓M↓C | Y↓M↓C↓K | M↓C↓K↓Y |

FIG.11

| LINE(COLUMN) | | | | | | | | | |
|---|---|---|---|---|---|---|---|---|---|
| m-1 | m | m+1 | m+2 | m+3 | m+4 | m+5 | m+6 | m+7 | m+8 |
| ⋮ | ⋮ | ⋮ | ⋮ | ⋮ | ⋮ | ⋮ | ⋮ | ⋮ | ⋮ |
| | Y | | M | | C | | K | | Y |
| K | | K | | Y | | M | | C | |
| | M | | C | | K | | Y | | M |
| Y | | Y | | M | | C | | K | |
| | C | | K | | Y | | M | | C |
| M | | M | | C | | K | | Y | |
| | K | | Y | | M | | C | | K |
| C | | C | | K | | Y | | M | |
| ⋮ | ⋮ | ⋮ | ⋮ | ⋮ | ⋮ | ⋮ | ⋮ | ⋮ | ⋮ |
| K↓Y↓M↓C | Y↓M↓C↓K | K↓Y↓M↓C | M↓C↓K↓Y | Y↓M↓C↓K | C↓K↓Y↓M | M↓C↓K↓Y | K↓Y↓M↓C | C↓K↓Y↓M | Y↓M↓C↓K |

INKJET PRINTER AND RECORDING HEADS UNIT

CROSS REFERENCE TO RELATED APPLICATION

The present application is a divisional application of U.S. patent application Ser. No. 10/723,274, filed on Nov. 25, 2003 now U.S. Pat. No. 7,008,042, the entire contents of which are incorporated herein by reference. The Ser. No. 10/723,274 application claimed the benefit of the date of the earlier filed Japanese Patent Application No. JP 2002-345431 filed Nov. 28, 2002 priority to which is also claimed herein.

BACKGROUND OF THE INVENTION

1. Field of the Invention

This invention relates to an inkjet printer and a recording heads unit, especially an inkjet printer and a recording heads unit having a structure capable of equalizing color tone of an image.

2. Description of Related Art

As a recording terminal connected to a word processor, a personal computer or the like, various kinds of printers such as a dot impact printer, an inkjet printer, a laser printer, a thermoelectric printer, a dye sublimation printer or the like have been developed. Among all, the inkjet printer has been a mainstream of a printer since it has advantages such as, recording images can be done more quietly, more easily, more inexpensively and the like than printers of the other methods.

In the inkjet printer, recording heads comprising lots of nozzles are placed. The inkjet printer jets ink as minute liquid drops from each nozzle at the recording heads toward a recording medium for recording images. The inkjet printer these days carries four arrayed recording heads on a carriage for spraying ink of each process color of yellow (Y), magenta (M), cyan (C) and black (K). By moving the carriage over the recording medium (back-and-forth movement), the inkjet printer is capable of recording a full-colored image easily.

Incidentally, when the carriage makes the back-and-forth movement over the recording medium, since the order of each recording head is fixed, the order of each recording head along a moving direction of the carriage differs between forth movement and back movement. In this case, in an image recording area, ink color piling order in an area corresponding to the forth movement is opposite to the order in an area corresponding to the back movement. As a result, color tone on a recording-finished image alternately changes at each area and thereby it causes degradation of image quality.

To solve this problem, there is a method of repeating the operation of followings: while the carriage moves over the recording medium, certain ink colors are formed whereas the rest of ink colors are not formed on each dot, and at the second or later movement, other ink colors are formed on the dot, which already has the certain ink colors formed thereon (formed by the carriage movement until the last time) (for example, refer to Japanese Patent Application Publication (Unexamined) No. Tokukai-Hei 5-278232). With this method, it is possible to locate pixels having different ink color piling order next to each other, and thereby it is possible to inhibit color tone change on a recording-finished image.

However, with the above-mentioned method, since it is necessary to form a dot by not piling the same color ink thereon but piling other color thereon, high-leveled technique such as controlling ink color piling order from each nozzle among recording head for jetting different ink colors from each other, is required. Consequently, a complicated control structure is required.

SUMMARY OF THE INVENTION

An embodiment of the present invention is to provide an inkjet printer and a recording heads unit capable of inhibiting alternate color tone change on a recording-finished image, by locating pixels next to each other having different ink color piling order to each other based on an easy structure.

In accordance with a first aspect of the present invention, an inkjet printer comprises: a plurality of recording heads for jetting ink having different colors from each other, wherein an image is recorded by moving the plurality of the recording heads over a recording medium that is conveyed along a conveyance direction, along a direction perpendicular to the conveyance direction; each of the plurality of recording heads comprises a plurality of nozzles for jetting the ink as minute liquid drops; the plurality of nozzles are arrayed at intervals of predetermined number of pixels along the conveyance direction in each of the plurality of recording heads; and each nozzle of one recording head is arranged at a position shifted from each nozzle of the other recording head along the conveyance direction of the recording medium so as to dispose each nozzle of the one recording head within the interval of the predetermined number of pixels between the nozzles of the other recording head.

In accordance with a second aspect of the present invention, A recording heads unit comprises: a plurality of recording heads for jetting ink having different colors from each other, wherein an image is recorded by moving the plurality of recording heads over a recording medium that is conveyed along a conveyance direction, along a direction perpendicular to the conveyance direction; each of the plurality of recording heads comprises a plurality of nozzles for jetting the ink as minute liquid drops; the plurality of nozzles are arrayed at intervals of predetermined number of pixels along the conveyance direction in each of the plurality of recording heads; and each nozzle of one recording head is arranged at a position shifted from each nozzle of the other recording head along the conveyance direction of the recording medium so as to dispose each nozzle of the one recording head within the interval of the predetermined number of pixels between the nozzle of the other recording head.

According to the printer of the first aspect or the unit of the second aspect of the present invention, since each nozzle of one recording head is arranged at a position shifted from each nozzle of the other recording head along a recording medium conveyance direction, when the recording heads move over the recoding medium once, a line made of dots by the one recording head and a line made of dots by the other recording head are alternately formed. By conveying the recording medium as much as predetermined amount and moving the recording heads over the recording medium once more, a color of the other recording head is formed on the line made of dots by the one recording head and a color of the one recording head is formed on the line made of dots by other recording head. In this case, lines having different ink color piling order are alternately formed on the recording medium, and pixels having different ink color piling order are located next to each other between each line. Accordingly, by having an easy structure where nozzle placement is shifted along the recording medium conveyance direction among each of the recording heads, it is possible to locate pixels having different ink color piling order next to each other, and thereby inhibit color tone change on a recording-finished image.

Preferably, in the printer of the first aspect or in the unit of the second aspect of the present invention, the plurality of recording heads include four recording heads for respectively jetting the ink of yellow, magenta, cyan and black; the plurality of nozzles are arrayed at intervals of three pixels; and each nozzle of three recording heads is arranged at a position shifted one pixel by one pixel from each nozzle of the other one recording head along the conveyance direction of the recording medium so as to dispose each nozzle of the three recording heads within the interval of three pixels between the nozzles of the other one recording head.

According to the printer or the unit, since, for example, nozzles of the three recording heads for jetting ink of M, C and K are arranged at positions shifted one pixel by one pixel from nozzles of the recording head for jetting ink of Y along the recording medium conveyance direction, when the recording heads moves over the recording medium once, lines of dots of each color, Y, M, C and K are repeatedly formed on the recording medium. By conveying the recording medium as much as predetermined amount and moving the recording heads, for example, ink K piles up on each dot of the lines of ink Y, ink Y piles up on each dot of the lines of ink M, ink M piles up on each dot of the lines of ink C, ink C piles up on each dot of the lines of ink K.

By repeating such operation, a line where ink piles up in the order of Y→K→C→M, a line where ink piles up in the order of M→Y→K→C, a line where ink piles up in the order of C→M→Y→K and a line where ink piles up in the order of K→C→M→Y are repeated at every four lines on the recording medium and pixels having different ink color piling order are located next to each other. Accordingly, by having an easy structure where nozzle placement is shifted along the recording medium conveyance direction among each of the recording heads, it is possible to locate pixels having different ink color piling order next to each other, and thereby inhibit color tone change on a recording-finished image.

Preferably, in the printer of the first aspect of in the unit of the second aspect of the present invention, the plurality of recording heads include four recording heads for respectively jetting the ink of yellow, magenta, cyan and black; the plurality of nozzles are arrayed at intervals of seven pixels; and each nozzle of three recording heads is arranged at a position shifted two pixels by two pixels from each nozzle of the other one recording head along the conveyance direction of the recording medium so as to dispose each nozzle of the three recording heads within the interval of seven pixels between the nozzles of the other one recording head.

According to the printer or the unit, since, for example, nozzles of the three recording heads for jetting ink of M, C and K are arranged at positions shifted two pixels by two pixels from nozzles of the recording head for jetting ink of Y along the recording medium conveyance direction, a line of each color, Y, M, C and K is formed at every two lines on the recording medium. Accordingly, in this case, since an interval as much as one pixel secured between each dot of lines located next to each other, it is possible to prevent from blending ink colors between each dot and thereby it is possible to improve image quality on a recording-finished image.

Preferably, in the printer of the first aspect or the unit of the second aspect of the present invention, the plurality of recording heads are combined with each other.

According to the printer or the unit, since the plurality of recording heads are combined with each other, it is possible to prevent misalignment among each of the recording heads. In this case, since misalignment among each of the recording heads does not happen, it is possible to equalize distance among each dot formed on the recording medium, and thereby it is possible to prevent from each dot unevenly positioning.

Preferably, the printer of the first aspect of the present invention further comprises light irradiation sections for irradiating light toward the recording medium; and a carriage capable of moving along the direction perpendicular to the conveyance direction, wherein the ink is capable of being cured by the light irradiated or heat caused by the light irradiated; the carriage comprises the plurality of recording heads and the light irradiation sections; and the light irradiation sections are placed at two locations apart from each other along the direction perpendicular to the conveyance direction, and the plurality of recording heads are placed between the light irradiation sections.

According to the printer, since the light irradiation sections are placed at two locations apart from each other along the carriage moving direction and the recording heads are placed between the light irradiation sections, whenever the carriage moves over the recording medium, one of the light irradiation sections located at a rear side toward the recording heads moving direction follows the recording heads. Further, since the ink jetted from the recording heads is capable of being cured by either light irradiation of heat caused by the light irradiation, immediately after the ink jetted from the recording heads lands on the recording medium during the move of the carriage, one of the light irradiation sections located at the rear side toward the recording heads moving direction irradiates light toward the recording medium. Accordingly, the ink which has just landed on the recording medium gets immediately cured according to either the light irradiation or the heat caused by the light irradiation. Consequently, it is possible to prevent from ink blotting on the recording medium.

In accordance with a third aspect of the present invention, an inkjet printer comprises a plurality of heads groups, each heads group comprising a plurality of line heads as one unit for jetting ink having different colors from each other, the plurality of line heads extending in a direction perpendicular to a conveyance direction in which a recording medium is conveyed, wherein the plurality of heads groups are arrayed from upstream to downstream along the conveyance direction; each of the plurality of line heads comprises a plurality of nozzles for jetting the ink as minute liquid drops; the plurality of nozzles are arrayed at intervals of predetermined number of pixels along a direction perpendicular to the conveyance direction in each of the plurality of line heads in each of the plurality of heads groups; each nozzle of one line head is arranged at a position shifted from each nozzle of the other line head along the direction perpendicular to the conveyance direction so as to dispose each nozzle of the one line head within the interval of the predetermined number of pixels between the nozzles of the other line head; the plurality of line heads in one heads group are arranged according to the plurality of line heads in the other heads group so as to dispose the plurality of nozzles in the line heads in the one heads group and the plurality of nozzles in the line heads in the other heads group on the same columns along the conveyance direction; and line heads having nozzles disposed on one same column jet the ink having different colors from each other.

In accordance with a fourth aspect of the present invention, a recording heads unit comprises a plurality of heads groups, each heads group comprising a plurality of line heads as one unit for jetting ink having different colors from each other, the plurality of line heads extending in a direction perpendicular to a conveyance direction in which a recording medium is conveyed, wherein the plurality of heads groups are arrayed from upstream to downstream along the conveyance direction; each of the plurality of line heads comprises a plurality of nozzles for jetting the ink as minute liquid drops; the plurality of nozzles are arrayed at intervals of predetermined number of pixels along a direction perpendicular to the conveyance direction in each of the plurality of line heads in each of the plurality of heads groups; each nozzle of one line head is arranged at a position shifted from each nozzle of the other line head along the direction perpendicular to the conveyance direction so as to dispose each nozzle of the one line head within the interval of the predetermined number of pixels between the nozzles of the other line head; the plurality of line heads in one heads group are arranged according to the plurality of line heads in the other heads group so as to dispose the plurality of nozzles in the line heads in the one heads group and the plurality of nozzles in the line heads in the other heads group on the same columns along the conveyance direction; and line heads having nozzles disposed on one same column jet the ink having different colors from each other.

According to the printer of the third aspect or the unit of the fourth aspect of the present invention, since each nozzle of one line head is arranged at a position shifted from each nozzle of the other recording head along the line head extending direction in each of the heads groups, whenever the recording medium passes under the one heads group, a line with dots made by the one line heads of the one heads group and a line with dots made by the other line head of the one heads group are alternately formed on the recording medium. Then, in the printer of the third aspect or in the unit of the fourth aspect of the present invention, since the plurality of line heads in one heads group are arranged according to the plurality of line heads in the other heads group so as to dispose the plurality of nozzles in the line heads in the one heads group and the plurality of nozzles in the line heads in the other heads group on the same columns along the recording medium conveyance direction, when the recording medium which already has passed under the one heads group passes the other heads group, the ink of the other heads group piles up on each line where the dots have been formed by the one heads group.

Here, since line heads having nozzles disposed on one same line jet the ink having different colors from each other in the printer of the third aspect or the unit of the fourth aspect of the present invention, when the recording medium passes under the other heads group, different color ink of the line heads in the other heads groups piles up on each dot, which has been formed by the one heads group. In this case, lines having different ink color piling order alternately line up on the recording medium, and therefore pixels having different ink color piling order are located next to each other between each line. Accordingly, by having an easy structure where nozzle placement is shifted along the line heads extending direction among line heads in each of the heads groups and line heads having nozzles disposed on one same column jet the ink having different colors from each other, it is possible to locate pixels having different ink color piling order next to each other and to inhibit color tone change on a recording-finished image.

Preferably, in the printer of the third aspect or in the unit of the fourth aspect of the present invention, the plurality of line heads in each of the plurality of heads groups include four line heads for respectively jetting the ink of yellow, magenta, cyan and black; the plurality of nozzles are arrayed at intervals of three pixels; and each nozzle of three line heads is arranged at a position shifted one pixel by one pixel from each nozzle of the other one line head along the direction perpendicular to the conveyance direction so as to dispose each nozzle of the three line heads within the interval of three pixels between the nozzles of the other one line head.

According to the printer or the unit, since, for example, each nozzle of the three line heads for jetting ink of M, C and K are arranged at a position shifted one pixel by one pixel from each nozzle of the line head for jetting color ink of Y along the line heads extending direction, whenever the recording medium passes under one heads group, lines of dots of each color, Y, M, C and K are repeatedly formed on the recording medium. Further, by passing the recording medium under one of the other heads groups, for example, the ink of M piles up on each dot formed with ink of Y, the ink of C piles up on each dot formed with ink of M, the ink of K piles up on each dot formed with ink of C and the ink of Y piles up on each dot formed with ink of K.

Furthermore, by passing the recording medium under the rest two heads groups, a line where the ink piles up in the order of Y→M→C→K, a line where the ink piles up in the order of M→C→K→Y, a line where the ink piles up in the order of C→K→Y→M and a line where the ink piles up in the order of K→Y→M→C are repeatedly formed on the recording medium at every four lines, and pixels having different ink color piling order are located next to each other between each line. Accordingly, by having an easy structure where nozzle placement is shifted along the line heads extending direction among the line heads in each heads group and line heads having nozzles disposed on one same column jet the ink having different colors from each other, it is possible to locate pixels having different ink color piling order next to each other and to inhibit color tone change on a recording-finished image.

Preferably, in the printer of the third aspect or the unit of the fourth aspect of the present invention, the plurality of line heads include four line heads for respectively jetting the ink of yellow, magenta, cyan and black; the plurality of nozzles are arrayed at intervals of seven pixels; and each nozzle of three line heads is arranged at a position shifted two pixels by two pixels from each nozzle of the other one line head along the direction perpendicular to the conveyance direction so as to dispose each nozzle of the three line heads within the interval of seven pixels between the nozzles of the other one line head.

According to the printer or the unit, since, for example, each nozzle of the three line heads for jetting ink of M, C and K is arranged at a position shifted two pixels by two pixels from each nozzle of the line head for jetting color ink of Y along the line heads extending direction, whenever the recording medium passes under each of the heads groups, lines of dots of each color, Y, M, C and K are repeatedly formed on the recording medium with an interval as much as one pixel. Accordingly, in this case, since the interval as much as one pixel is secured between each dot of lines located next to each other, it is possible to prevent from blending ink colors between each dot and thereby it is possible to improve image quality on a recording-finished image.

Preferably, in the printer of the third aspect or the unit of the fourth aspect of the present invention, the plurality of line heads in each of the plurality of heads groups are combined with each other.

According to the printer or the unit, since the plurality of line heads in each of the plurality of heads groups are combined with each other, it is possible to prevent misalignment among each of the line heads. In this case, since misalignment among each of the recording heads does not happen, it is possible to equalize distance among each dot formed on the recording medium, and thereby it is possible to prevent from each dot unevenly positioning.

Preferably, in the printer of the third aspect of the present invention, a light irradiation section is placed at a downstream side from the plurality of heads groups along the conveyance direction for irradiating light toward the recording medium and the ink is capable of being cured by the light irradiated or heat caused by the light irradiated. According to the printer, since the light irradiation section is located at a downstream side from the heads groups along the recording medium conveyance direction, as soon as the recording medium passes under the heads groups, the light irradiation section irradiates light toward the recording medium. Accordingly, since the ink jetted from the line heads in each of the heads group is capable of being cured by either light irradiation or heat caused by the light irradiation and the ink gets either the light irradiation or the heat of the light irradiation immediately after the ink jetted from the line heads in each of the heads groups lands on the recording medium, it is possible to prevent from ink blotting on the recording medium.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 3 is a chart compiling a line location in an image recording area of a recording medium, an ink color jetted on each pixel of the line and ink color piling order based on the nozzle placement shown in FIG. 2, FIG. 5 is a chart compiling a line location in the image recording area of the recording medium, an ink color jetted on each pixel of the line and ink color piling order based on the nozzle placement shown in FIG. 4, FIG. 8 is a chart compiling a line location in the image recording area of the recording medium (upper part), an ink color jetted on each pixel of a line corresponding to the line location shown at upper part (middle part), and piling order of ink colors jetted on each pixel of the line corresponding to the line location shown at upper part (bottom part) based on the nozzle placement shown in FIG. 7, FIG. 11 is a chart compiling a line location in the image recording area of the recording medium (upper part), an ink color jetted on each pixel of a line corresponding to the line location shown at upper part (middle part), and piling order of ink colors jetted on each pixel of the line corresponding to the line location shown at upper part (bottom part) based on the nozzle placement shown in FIG. 10.

AN EMBODIMENT OF THE INVENTION

Hereinafter, an embodiment of an inkjet printer in the present invention will be explained with reference to figures. However, the range of the invention is not limited to the illustrated figures.

First, with reference to FIG. 1 to FIG. 5, a first embodiment of the inkjet printer in the present invention will be explained.

Figure 1:
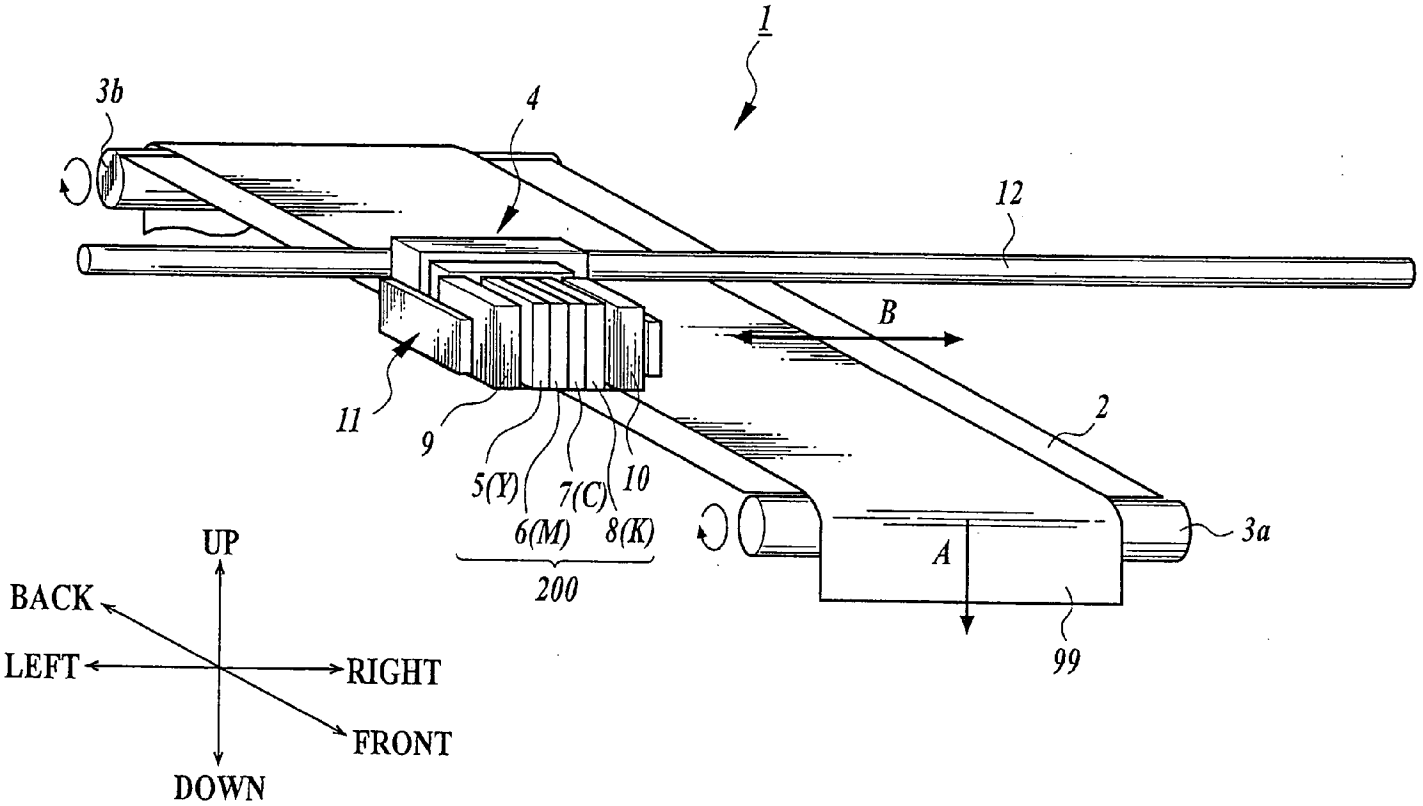
FIG. 1 is a perspective view showing a rough structure of an inkjet printer according to a first embodiment.

FIG. 1 is a perspective view showing a rough structure of an inkjet printer 1.

As shown in FIG. 1, the inkjet printer 1 comprises a platen 2, which has a flat-plate shape and supports a non-recording surface of a recording medium 99 (a surface opposite to a recording surface). At the front part and the back part of the platen 2, conveyance rollers 3*a* and 3*b* are placed respectively. Conveyance motors (not shown) are connected to each of the conveyance rollers 3*a* and 3*b*, and in accordance with driving force from each conveyance motor, each of the conveyance rollers 3*a* and 3*b* rotates respectively at the front part and at the back part of the platen 2 in a predetermined direction around their axes (refer to an arrow in FIG. 1). Then, by rotating each of the rollers 3*a* and 3*b*, the recording medium 99 is conveyed along a conveyance direction A.

Above the platen 2, an image recording unit 4 for recording images on the recording surface of the recording medium 99 is placed. The image recording unit 4 comprises a guide portion 12, which extends along a direction B (hereafter, it is called "a scan direction B") perpendicular to the conveyance direction A, and the guide portion 12 supports a carriage 11. The carriage 11 is capable of moving along the scan direction B while being guided by the guide portion 12.

In addition, the carriage 11 is capable of moving to a location away from where the carriage is opposed to the platen 2, as shown at the left part in FIG. 1 (hereafter, it is called "a home position"). When the inkjet printer 1 does not record an image, the carriage 11 stands by at the home position in preparation for recording operation.

On the carriage 11, a recording heads unit 200 is placed. The recording heads unit 200 is composed of four recording heads 5, 6, 7 and 8 for jetting each process color of Y, M, C and K respectively toward the recording surface of the recording medium 99, while simultaneously following the back-and-forth movement of the carriage 11. In the recording heads unit 200, the four recording heads 5, 6, 7 and 8 are combined with each other for preventing misalignment thereamong.

Further, at both left and right sides of the carriage 11, two ultraviolet rays irradiation units 9 and 10 are respectively placed as light irradiation sections. The ultraviolet rays irradiation units 9 and 10, as well as the recording heads 5, 6, 7 and 8, follow the back-and-forth movement of the carriage 11. In each of the ultraviolet rays irradiation units 9 and 10, an ultraviolet rays source (not shown) for irradiating ultraviolet rays is respectively placed, and each of the ultraviolet rays irradiation units 9 and 10 is capable of irradiating ultraviolet rays toward the recording surface of the recording medium 99 by turning the ultraviolet rays source on. As the ultraviolet rays source, a high-pressure mercury lamp, a metal halide lamp, a black light, a cold-cathode tube, an LED (Light Emitting Diode) or the like can be applied.

Figure 2:
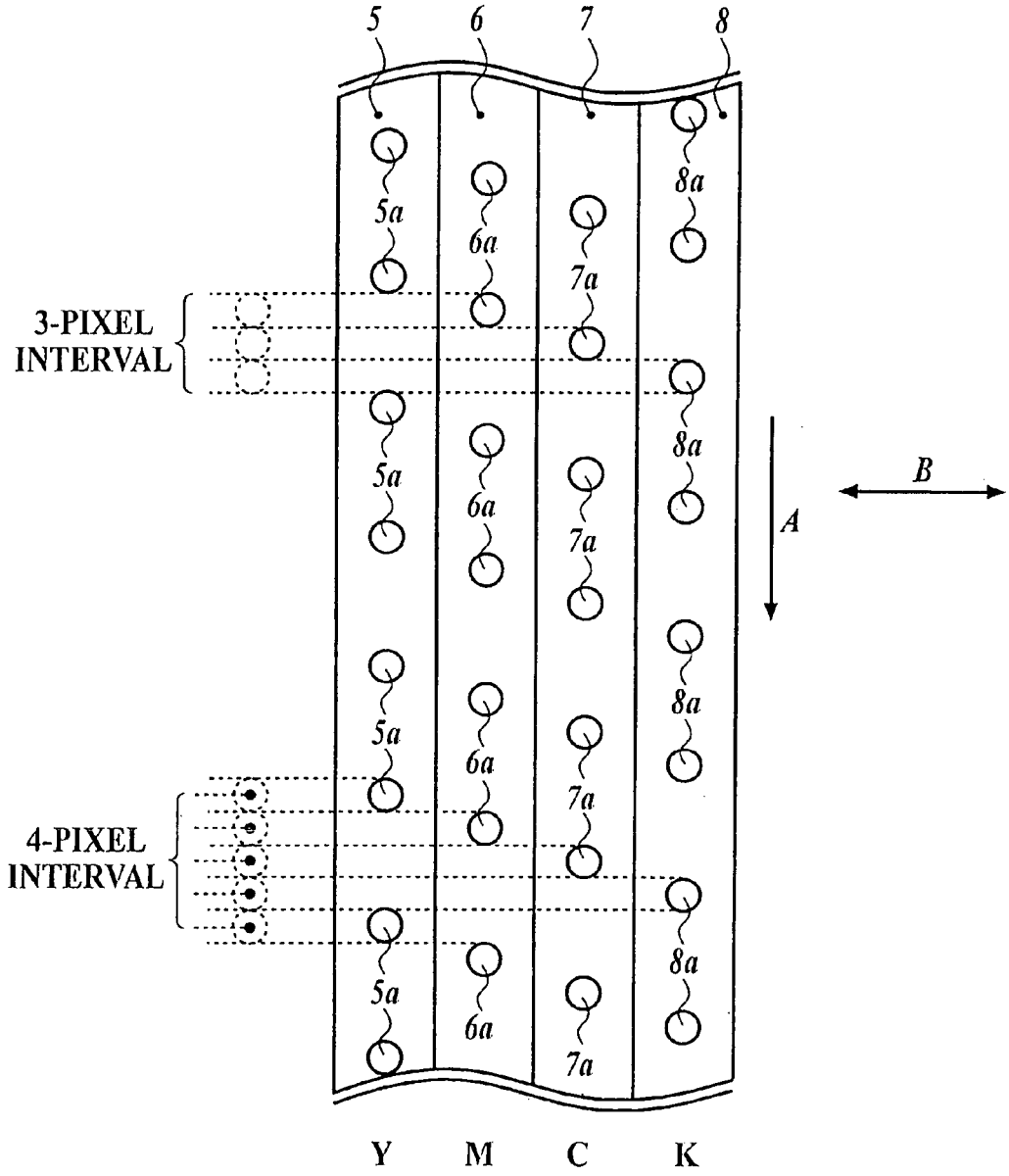
FIG. 2 is a plan view showing nozzle placement among each recording head.

FIG. 2 is a magnified plan view showing a part of under surfaces (surfaces opposed to the platen 2) of each of the recording heads 5, 6, 7 and 8 shown in FIG. 1.

As shown in FIG. 2, on the under surface of each of the recording heads 5, 6, 7 and 8, a plurality of nozzles 5*a*, 5*a*, . . . , 8*a*, 8*a*, are placed respectively. Each of the nozzles 5*a* to 8*a* is a jetting gate for jetting ink of a color corresponding to each of the recording heads 5, 6, 7 and 8 as minute liquid drops.

The plurality of nozzles 5*a*, 5*a*, . . . are arrayed in-line along the conveyance direction A of the recording medium 99, with a three-pixel interval secured therebetween. The nozzle 6*a*, 7*a* and 8*a* are arrayed in the same way.

Further, the nozzle 6*a* is placed with one pixel shifted from the nozzle 5*a* along the conveyance direction A, the nozzle 7*a* is placed with one pixel shifted from the nozzle 6*a* along the conveyance direction A and the nozzle 8*a* is placed with one pixel shifted from the nozzle 7*a* along the conveyance direction A. In other words, within the three-pixel interval between each nozzle 5*a*, the nozzles 6*a*, 7*a* and 8*a* are respectively arranged with one pixel shifted from the nozzle 5*a*, 6*a* and 7*a* to the right in the mentioned nozzle order, along the conveyance direction A.

In each of the recording heads 5, 6, 7 and 8 having such nozzle placement, on each line along the scan direction B (horizontal rows divided by dotted lines in FIG. 2), only one among the nozzles 5*a*, 6*a*, 7*a* and 8*a* exists respectively. Conversely, on the same row, two or more nozzles for jetting different ink colors do not exist.

Incidentally, the description above says that there is an interval as much as three pixels secured between each of the nozzles 5*a* to 8*a* at each of the recording heads 5, 6, 7 and 8 (refer to FIG. 2). However, to be precise, since the recording heads 5, 6, 7 and 8 jet ink from center parts of the nozzles 5*a* to 8*a*, there is an interval as much as four pixels secured between each of the center parts of the nozzles 5*a* to 8*a* at each of the recording heads 5, 6, 7 and 8.

Next, ink used in the first embodiment will be explained.

As the ink used in the first embodiment, in particular, ink adapted to "Photo Curing System using photooxidation, base generating agent (Section 1)" or "Photoinduced type alternating copolymer (Section 2)" in "Photo Curing System (Chapter 4)" written in "Photo Curing Technique—selection of resin and initiator, and measurement and evaluation of combination conditions and cure extent (Technique Association Information)" or the like is applicable. Further, ink capable of getting photo-cured with general radical polymerization is applicable as well.

Concretely, the ink used in the first embodiment is photo-curing type ink having property capable of getting photo-cured with irradiation of ultraviolet rays as light thereon. The ink includes, as main components, at least polymerized compound (including publicly known polymerized compound), photoinitiator and coloring material. However, if ink adapted to the above-mentioned "Photoinduced type alternating copolymer (Section 2)" is to be used in the first embodiment, the photoinitiator may be excluded.

The above-mentioned photo-curing type ink, as polymerism chemical compound, is roughly classified into a radical polymerization ink type including radical polymerization chemical compound and a cationic polymerization ink type including cationic polymerization chemical compound. Both the types of ink are respectively applicable to be used in the first embodiment. Further, hybrid type ink compounding both radical polymerization ink and cationic polymerization ink is also applicable to be used in the first embodiment.

Next, the recording medium 99 used in the first embodiment will be explained.

As the recording medium 99 used in the first embodiment, various types of paper applied to a general inkjet printer such as a recording medium made of plain paper, regenerated paper, glossy paper or the like, various type of textile, various types of nonwoven fabric, resin, metal, glass or the like is applicable. As a shape of the recording medium 99, a roll shape, a cut-sheet shape, a plate shape or the like are applicable. In the present first embodiment, long plate film made of resin wound in a roll shape is used.

Next, operation of the inkjet printer 1 according to the first embodiment will be explained.

Before image recording operation, the recording medium 99 hangs between each of the conveyance rollers 3*a* and 3*b* while the non-recording surface thereof is supported by the platen 2 and the carriage 11 stands by at the home position as shown at the left part in FIG. 1.

Then, when the image recording operation starts, the conveyance motors connected to each of the conveyance rollers 3*a* and 3*b* drive each of the conveyance motors 3*a* and 3*b* to rotate for predetermined amount and stop. Thereby, the recording medium 99 is conveyed from back to forth between the platen 2 and the image recording unit 4 for predetermined amount and stopped.

Thereafter, the carriage 11 is activated and moves over the recording medium 99 along the scan direction B from left to right in FIG. 1, and the four recording heads 5, 6, 7 and 8 and the two ultraviolet rays irradiation units 9 and 10, as following the movement of the carriage, also move over the recording medium 99 along the scan direction B from left to right.

Hereafter, to simplify explanations in regard to the moving direction of the carriage 11, the four recording heads 5, 6, 7 and 8, and the ultraviolet rays irradiation units 9 and 10, movement of these components from left to right in FIG. 1 is called "forth movement", and movement of these components from right to left is called "back movement".

Then, while each of the recording heads 5, 6, 7 and 8 are making forth movement over an image recording area (an area for recording images) of the recording surface of the recording medium 99, each of the recording heads 5, 6, 7 and 8 respectively jets ink from the nozzles 5*a* to 8*a* toward the image recording area as minute liquid drops.

Simultaneously, the ultraviolet rays source of the ultraviolet irradiation unit 9 placed at the left part in FIG. 1 is turned on for irradiating ultraviolet rays on ink which has just landed on the recording medium 99. Then, the ink is cured and fixated on the recording surface of the recording medium 99.

Thereafter, the conveyance motors re-drive each of the conveyance rollers 3*a* and 3*b* to rotate for predetermined amount and stop. Thereby, the recording medium 99 is further conveyed from back to forth for predetermined amount and stopped.

Thereafter, the carriage is re-activated and the four recording heads 5, 6, 7 and 8 and the two ultraviolet irradiation units 9 and 10 make back movement over the recording medium along the scan direction B. Then, while making back movement above the image recording area of the recording medium 99, each of the recording heads 5, 6, 7 and 8 respectively jets ink from the nozzles 5*a* to 8*a* toward the image recording area as minute liquid drops.

Simultaneously, the ultraviolet rays source of the ultraviolet irradiation unit 10 placed at the right part in FIG. 1 is turned on for irradiating ultraviolet rays on ink which has just landed on the recording medium 99. Then, the ink is cured and fixated on the recording surface of the recording medium.

Afterward, with the above-mentioned operation repeated in the inkjet printer 1, an image is sequentially recorded on the image recording area of the recording surface of the recording medium 99 which has passed between the platen 2 and the image recording unit 4.

In other words, in the inkjet printer 1, the recording medium 99 is conveyed along the conveyance direction A intermittently while the predetermined amount movement and a stop is repeated. When the recording medium 99 is stopped, the carriage 11 is activated and the four recording heads 5, 6, 7 and 8 and the two ultraviolet irradiation units 9 and 10 make either forth movement or back movement over the recording medium 99 supported by the platen 2. Then, while making either forth movement or back movement, each of the recording heads 5, 6, 7 and 8 jets ink toward the recording medium 99. Further, Simultaneously, either the ultraviolet irradiation unit 9 or 10 located at a rear side toward the moving direction of each of the recording heads 5, 6, 7 and 8 is turned on for irradiating ultraviolet rays on ink which has just landed on the recording medium 99, and the ink is immediately cured and fixated on the recording medium 99.

Further, the recording medium 99, which is intermittently conveyed, moves as much as predetermined number of pixels according to total number of the nozzles 5*a* to 8*a* of each of the recording heads 5, 6, 7 and 8 whenever each recording heads 5, 6, 7 and 8 scans (makes either forth movement or back movement). In the inkjet printer 1, conveyance amount of the recording medium 99 is optimized according to the total number of the nozzles 5*a* to 8*a* of each of the recording head 5, 6, 7 and 8.

Concretely, if the total number of the nozzles 5*a* to 8*a* at each of the recording heads 5, 6, 7 and 8 is $2^x$ (x is a positive integer and no fewer than 4), nozzle column length is as much as ($2^x \times 4$) pixels, and whenever each of the recording heads 5, 6, 7 and 8 scans (makes either forth movement or back movement), the recording medium 99 moves as much as ($2^x-1$) pixels. Here, the nozzle column length means distance between the most downstream located 5*a* and the most upstream located 8*a* along the conveyance direction A among all the nozzles 5*a*, 5*a*, . . . 8*a*, 8*a*, . . . of the four recording heads 5, 6, 7 and 8. In this case, each of the recording heads 5, 6, 7 and 8 is set to jet ink from the nozzles 5*a* to 8*a* except for the most downstream located nozzles 5*a*, 6*a*, 7*a* and 8*a* along the conveyance direction A while making either forth movement or back movement.

For example, if the total number of the nozzles 5*a* to 8*a* of each of the recording heads 5, 6, 7 and 8 is 128 ($=2^T$), the nozzle column length is as much as 512 pixels ($=2^T \times 4$) and the recording medium 99 moves as much as 127 pixels ($2^T-1$) whenever each of the recording heads 5, 6, 7 and 8 scans (makes either forth movement or back movement). In this case, while making either forth movement or back movement, each of the recording heads 5, 6, 7 and 8 jets ink from all the nozzles 5*a* to 8*a* except for the most downstream located nozzles 5*a*, 6*a*, 7*a* and 8*a* along the conveyance direction A.

Further, if the total number of the nozzles 5*a* to 8*a* of each of the recording heads 5, 6, 7 and 8 is ($2^x-1$), the nozzle column length is as much as ($(2^x-1)\times 4$) pixels and the recording medium 99 moves as much as ($2^x-1$) pixels whenever each of the recording heads 5, 6, 7 and 8 scans (makes either forth movement or back movement). In this case, while making either forth movement or back movement, each of the recording heads 5, 6, 7 and 8 jets ink from all the nozzles 5*a* to 8*a*.

For example, if the total number of the nozzles 5*a* to 8*a* of each of the recording heads 5, 6, 7 and 8 is 127 ($=2^T-1$), the nozzle column length is as much as 508 pixels ($=(2^T-1)\times 4$) and the recording medium moves as much as 127 pixels ($=2^T-1$) whenever each of the recording heads 5, 6, 7 and 8 scans (makes either forth movement and back movement). In this case, while making either forth movement or back movement, each of the recording heads 5, 6, 7 and 8 jets ink from all the nozzles 5*a* to 8*a*.

Incidentally, the cases where total number of the nozzles 5*a* to 8*a* of each of the recording heads 5, 6, 7 and 8 is $2^x$ and ($2^x-1$) are explained. However, the total number of the nozzles 5*a* to 8*a* can accordingly be changed, and conveyance amount of the recording medium 99 can accordingly be optimized according to the total number of the nozzles 5*a* to 8*a* of each of the recording heads 5, 6, 7 and 8.

Here, with reference to FIG. 3, an ink color jetted on each pixel within the image recording area and piling order of ink color will be explained. However, in the explanation hereafter, the case where total number of the nozzles 5*a* to 8*a* of each of the recording heads 5, 6, 7 and 8 is either $2^x$ or ($2^x-1$), and the recording medium 99 moves as much as ($2^x-1$) pixels whenever each of the recording heads 5, 6, 7 and 8 scans (makes either forth movement or back movement), is assumed.

FIG. 3 is a chart compiling a line (row) location in the image recording area of the recording medium 99, an ink color jetted on each pixel of the line and ink color piling order. However, the image recording area is assumed to be composed of 2n lines, which are 1, 2, . . . , n−1, n, n+1, . . . , 2n−1, 2n (n is any positive integer).

When the nozzle 5*a* of the recording head 5 passes over the line (n) at a first scan (forth movement) among a plurality of scans of the recording heads 5, 6, 7 and 8, ink Y is jetted on each pixel of the line (n). Then, as shown in FIG. 2, since the nozzles 6*a*, 7*a* and 8*a* are respectively arranged with one pixel shifted from the nozzle 5*a*, 6*a* and 7*a* along the conveyance direction A in the mentioned order, ink M is jetted on each pixel of the line (n−1), ink C is jetted on each pixel of the line (n−2), and ink K is jetted on each pixel of the line (n−3).

Thereafter, the recording medium 99 is conveyed as much as predetermined number of pixels according to the total number of the nozzles 5*a* to 8*a* of each of the recording heads 5, 6, 7 and 8. Then, at a second scan (back movement) coming after the first scan, the nozzle 8*a* of the recording head 8 passes over the line (n) and ink K is jetted on each pixel of the line (n). At the same time, since the nozzles 5*a*, 6*a* and 7*a* are respectively arranged with one pixel shifted from the nozzle 8*a*, 5*a* and 6*a* along the conveyance direction A in the mentioned order, ink Y is jetted on each pixel of the line (n−1), ink M is jetted on each pixel of the line (n−2), and ink C is jetted on each pixel of the line (n−3).

Thereafter, as well as the operation at the second scan, with the conveyance of the recording medium 99 and a third scan (forth movement) coming after the second scan, ink C is jetted on each pixel of the line (n), ink K is jetted on each pixel of the line (n−1), ink Y is jetted on each pixel of the line (n−2), and ink M is jetted on each pixel of the line (n−3).

Thereafter, with the conveyance of the recording medium 99 and a fourth scan (back movement) coming after the third scan, ink M is jetted on each pixel of the line (n), ink C is jetted on each pixel of the line (n−1), ink K is jetted on each pixel of the line (n−2), and ink Y is jetted on each pixel of the line (n−3).

Then, by having the recording heads 5, 6, 7 and 8 scan four times, which are the first, second, third and fourth scans as mentioned above, image recording on each of the lines (n) to (n−3) is completed. Here, as shown in FIG. 3, each ink color piles up in the order of Y→K→C→M on each pixel of the line (n), in the order of M→Y→K→C→on each pixel of the line (n−1), in the order of C→M→Y K on each pixel of the line (n−2), and in the order of K→C→M→Y on each pixel of the line (n−3). Further, by doing the first, second, third and forth scans in the same way as mentioned above on the lines before the line (n−3) and the lines after the line (n), a line where each ink color piles up in the order of Y→K→C→M, a line where each ink color piles up in the order of M→Y→K→C, a line where each ink color piles up in the order of C→M→Y→K, and a line where each ink color piles up in the order of K→C→M→Y repeatedly line up in the mentioned line order with a cycle of the four lines (n), (n−1), (n−2) and (n−3) continued.

In other words, in the image recording area composed of the 2n lines, the line where each color ink piles up in the order of Y→K→C→M, the line where each color ink piles up in the order of M→Y→K→C, the line where each color ink piles up in the order of C→M→Y→K, and the line where each color ink piles up in the order of K→C→M→Y are respectively repeated at every four lines.

In the above-mentioned inkjet printer 1 of the first embodiment, each ink color of Y, M, C and K piles up in any one of the above-mentioned four different orders for forming each line of the image recording area, and lines located next to each other have different ink color piling orders. Accordingly, between each line, pixels having different ink color piling orders are located to each other. Thereby, by having an easy structure where nozzle placement is shifted one pixel by one pixel between each of the recording heads 5, 6, 7 and 8 along the conveyance direction of the recording medium 99, it is possible to locate pixels having different ink color piling orders to each other. Consequently, it is possible to inhibit color tone change on a recording-finished image.

Further, in the present first embodiment, since the recording heads 5, 6, 7 and 8 are combined with each other, misalignment of the nozzles among each of the recording heads 5, 6, 7 and 8 does not happen. Consequently, it is possible to equalize distance among each dot formed in the image recording area of the recording medium 99, and thereby it is possible to prevent from each dot unevenly positioning in the image recording area.

Next, with reference to FIG. 4, alternative nozzle placement instead of the nozzle placement of FIG. 2 will be explained.

Figure 4:
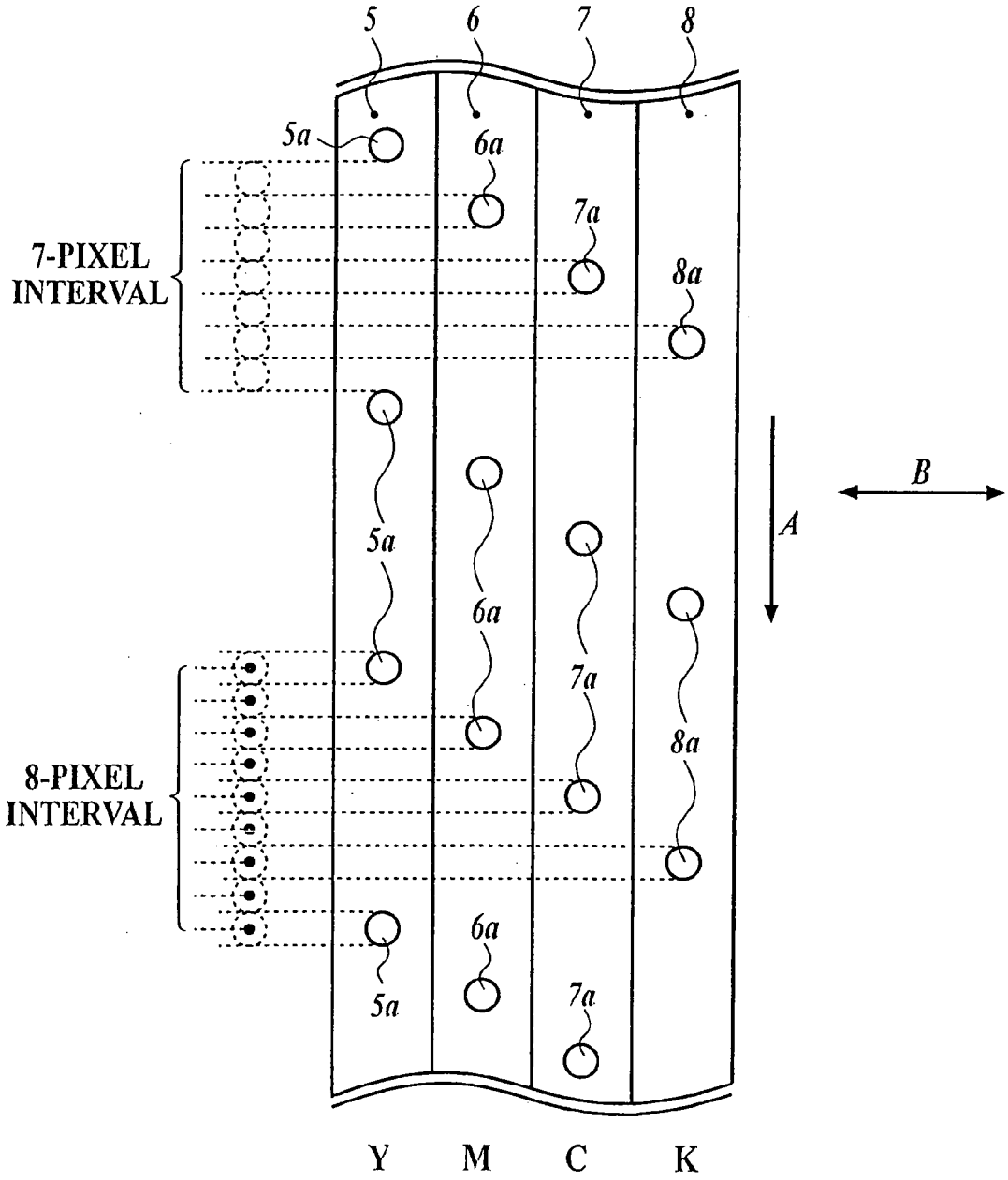
FIG. 4 is a plan view showing an alternative of the nozzle placement shown in FIG. 2.

FIG. 4 is a view showing an alternative of the nozzle placement shown in FIG. 2, and a magnified plan view showing under surfaces of each of the recording heads 5, 6, 7 and 8.

A plurality of nozzles 5*a*, 5*a*, . . . , 8*a*, 8*a*, . . . are arrayed in-line along the conveyance direction A at each of the recording heads 5, 6, 7 and 8, as well as the nozzles 5*a* to 8*a* shown in FIG. 2.

Then, between each nozzle 5*a* of the recording head 5, there is an interval as much as seven pixels secured. Also, between each of the other nozzles 6*a* to 8*a*, there is an interval as much as seven pixels secured.

Further, the nozzle 6*a* is placed with two pixels shifted from the nozzle 5*a* along the conveyance direction A, the nozzle 7*a* is placed with two pixels shifted from the nozzle 6*a* along the conveyance direction A, and the nozzle 8*a* is placed with two pixels shifted from the nozzle 7*a* along the conveyance direction A. In other words, the nozzles 5*a*, 6*a*, 7*a* and 8*a* are placed with one-pixel interval therebetween along the conveyance direction A in the mentioned order and each of the nozzles 6*a*, 7*a* and 8*a* are disposed within the seven-pixel interval between each nozzle 5*a*.

Among each of the recording heads 5, 6, 7 and 8 having such nozzle placement, there are lines either where only one among the nozzles 5*a*, 6*a*, 7*a* and 8*a* exists or where no nozzle exists, and the line with a nozzle and the line without a nozzle line up alternately.

Incidentally, the description above says that there is an interval as much as seven pixels secured between each of the nozzles 5*a* to 8*a* at each of the recording heads 5, 6, 7 and 8 (refer to FIG. 4). However, to be precise, since the recording heads 5, 6, 7 and 8 jet ink from center parts of the nozzles 5*a* to 8*a*, there is an interval as much as 8 pixels secured between each of the center parts of the nozzles 5*a* to 8*a* at each of the recording heads 5, 6, 7 and 8.

Then, if the nozzle placement of FIG. 4 is used instead of that of FIG. 2, in the inkjet printer 1, approximately the same as the above-mentioned operation, an image is recorded on the recording medium with the intermittent conveyance of the recording medium 99 in conjunction with the operation of the carriage 11, the recording heads 5, 6, 7 and 8, and the ultraviolet irradiation units 9 and 10.

In addition, in this case, whenever each of the recording heads 5, 6, 7 and 8 scans, the recording medium 99 is conveyed as much as predetermined number of pixels according to total number of the nozzles 5*a* to 8*a* of each of the recording heads 5, 6, 7 and 8. However, since the nozzle placement of FIG. 4 is somewhat different from that of FIG. 2, conveyance distance of the recording medium 99 is optimized according to the total number of the nozzles 5*a* to 8*a* of each of the recording heads 5, 6, 7 and 8, and the nozzle placement.

Concretely, if the total number of the nozzles 5*a* to 8*a* of each of the recording heads 5, 6, 7 and 8 is $2^y$ (y is a positive integer and no fewer than 4), nozzle column length is as much as ($2^y \times 4 \times 2$) pixels, and the recording medium 99 is conveyed as much as ($2^y-3$) pixels whenever each of the recording heads 5, 6, 7 and 8 scans (makes either forth movement or back movement). Here, the nozzle column length means distance between the most downstream located 5*a* and the most upstream located 8*a* along the conveyance direction A plus a size of one pixel. In this case, each of the recording heads 5, 6, 7 and 8 is set to jet ink from all the nozzles 5*a* to 8*a* except for three nozzles located the most downstream along the conveyance direction A while making either forth movement or back movement.

For example, if the total number of the nozzles 5*a* to 8*a* of each of the recording heads 5, 6, 7 and 8 is 128 ($=2^T$), nozzle column length is as much as 1024 ($=2^T \times 4 \times 2$) pixels and the recording medium 99 is conveyed as much as 125 ($=2^T-3$) pixels. In this case, each of the recording heads 5, 6, 7 and 8 jets ink from all the nozzles 5*a* to 8*a* except for three nozzles located the most downstream along the conveyance direction A while making either forth movement or back movement.

Further, if the total number of the nozzles 5*a* to 8*a* of each of the recording heads 5, 6, 7 and 8 is ($2^y$−3), nozzle column length is as much as (($2^y$−3)×4×2) pixels and the recording medium 99 is conveyed as much as ($2^y$−3) pixels whenever each of the recording heads 5, 6, 7 and 8 scans (makes either forth movement or back movement). In this case, each of the recording heads 5, 6, 7 and 8 is set to jet ink from all the nozzles 5*a* to 8*a* while making either forth movement or back movement.

For example, if the total number of the nozzles 5*a* to 8*a* of each of the recording heads 5, 6, 7 and 8 is 125 ($2^T$−3), nozzle column length is as much as 1000 (=($2^T$−3)×4×2) pixels and recording medium 99 is conveyed as much as 125 ($2^T$−3) pixels whenever each of the recording heads 5, 6, 7 and 8 scans (makes either forth movement or back movement). In this case, each of the recording heads 5, 6, 7 and 8 is set to jet ink from all the nozzles 5*a* to 8*a* while making either forth movement or back movement.

Incidentally, the cases where the total number of the nozzles 5*a* to 8*a* of each of the recording heads 5, 6, 7 and 8 is either $2^y$ and ($2^y$−3) are explained. However, the total number of the nozzles 5*a* to 8*a* of each of the recording heads 5, 6, 7 and 8 can accordingly be changed, and conveyance distance of the recording medium 99 can accordingly be optimized according to the total number of the nozzles 5*a* to 8*a* of each of the recording heads 5, 6, 7 and 8.

Here, with reference to FIG. 5, an ink color jetted on each pixel within the image recording area and its ink color piling order in the case of using the nozzle placement of FIG. 4 instead of that of FIG. 2 will be explained. However, in the explanation hereafter, the case where total number of the nozzles 5*a* to 8*a* of each of the recording heads 5, 6, 7 and 8 is either $2^y$ or ($2^y$−3), and the recording medium 99 is conveyed as much as ($2^y$−3) pixels whenever each of the recording heads 5, 6, 7 and 8 scans (makes either forth movement or back movement), is assumed.

FIG. 5, approximately the same as FIG. 3, is a chart compiling a line (row) in the image recording area, an ink color jetted on each pixel of the line and ink color piling order.

When the nozzle 5*a* of the recoding head 5 passes over a line (n) at a first scan (forth movement) as one of the scans of odd times among a plurality of scans of the recording heads 5, 6, 7 and 8, ink Y is jetted on each pixel of the line (n). Then, as shown in FIG. 4, since the nozzles 6*a*, 7*a* and 8*a* are respectively arranged with two pixels shifted from the nozzles 5*a*, 6*a* and 7*a* in the mentioned order along the conveyance direction A, ink M is jetted on each pixel of a line (n−2), ink C is jetted on each pixel of a line (n−4) and ink K is jetted on each pixel of a line (n−6).

Thereafter, the recording medium 99 is conveyed as much as predetermined number of pixels according to the total number of the nozzles 5*a* to 8*a* of each of the recording heads 5, 6, 7 and 8. Then, at a second scan (back movement) coming after the first scan, the nozzle 7*a* of the recording head 7 passes over a line (n−1) for jetting ink C on each pixel thereof. At the same time, since the nozzles 8*a*, 5*a* and 6*a* are respectively arranged with two pixels shifted from the nozzle 7*a*, 8*a* and 5*a* in the mentioned order along the conveyance direction A, ink K is jetted on each pixel of a line (n−3), ink Y is jetted on each pixel of a line (n−5) and ink M is jetted on each pixel of a line (n−7).

Thereafter, as well as the second scan, since the conveyance of the recording medium 99 and a third to eighth scans coming after the second scan are repeated, image recording on each of the lines (n) to (n−7) is completed. Here, as shown in FIG. 5, each color ink piles up in the order of Y→K→C→M on each pixel of the lines (n) and (n−5), C→M→Y→K on each pixel of the lines (n−1) and (n−4), M→→Y K→C on each pixel of the lines (n−2) and (n−7) and K→C→M→Y on each pixel of the lines (n−3) and (n−6). Further, by having the recording heads 5, 6, 7 and 8 do the first to the eighth scans, in the lines before the line (n−7) and after the line (n), a line where each ink color piles up in the order of Y→K→C→M, a line where each ink color piles up in the order of C→M→Y→K, a line where each ink color piles up in the order of M→Y→K→C and a line where each ink color piles up in the order of K→C→M→Y repeatedly line up with a cycle of the ink piling order of each of the lines (n) to (n−7) continued.

As mentioned above, even in the case of using the nozzle placement of FIG. 4 instead of that of FIG. 2, each ink color Y, M, C and K piles up in any one of the above-mentioned four different orders for forming each line of the image recording area, and lines located next to each other have different ink color piling order. Accordingly, between each line, pixels having different ink color piling order are located next to each other. Thereby, by having an easy structure where nozzle placement is shifted with two pixels between each of the recording heads 5, 6, 7 and 8 along the conveyance direction of the recording medium 99, it is possible to locate pixels having different ink color piling order next to each other. Consequently, it is possible to prevent color tone change on a recording-finished image.

Further, in the case of using the nozzle placement of FIG. 4 instead of that of FIG. 2, since the three nozzles 6*a*, 7*a* and 8*a*, which jet the ink of M, C and K respectively, of the recording heads 6, 7, and 8 are respectively arranged at positions shifted two pixels by two pixels from the nozzle 5*a*, which jets ink color Y, of the recording head 5 in the mentioned order, lines of dots of each color Y, M, C and K are alternately formed at every two lines in the image recording area of the recording medium 99 whenever each of the recording heads 5, 6, 7 and 8 scans. Therefore, in this case, since there is an interval as much as one pixel between each line located next to each other, it is possible to prevent from blending ink between each dot formed in the image recording area, and thereby it is possible to improve image quality on a recording-finished image.

In addition, in the first embodiment, the example where the recording head 5 for jetting ink Y, the recording head 6 for jetting ink M, the recording head 7 for jetting ink C and the recording head 8 for jetting ink K are arrayed along the scan direction B in the mentioned order is cited. However, it is possible to change the order of the recording heads 5, 6, 7 and 8, or change ink colors (Y, M, C and K) jetted from each of the recording heads 5, 6, 7 and 8 without changing the order of the recording heads 5, 6, 7 and 8.

Subsequently, with reference to FIG. 6 to FIG. 11, a second embodiment of the inkjet printer 1 of the present invention will be explained. Here, a structure of the image recording unit 4 (refer to FIG. 1) in the second embodiment is different from that in the above-mentioned first embodiment, and the other structures (including the ink and the recording medium 99) are the same as the above-mentioned first embodiment. In the second embodiment, the image recording unit 4 will mainly be explained. Therefore, the same symbols of the first embodiment are added to the corresponding structures in the second embodiment and explanation of the structures with the same symbols in detail is omitted.

Figure 6:
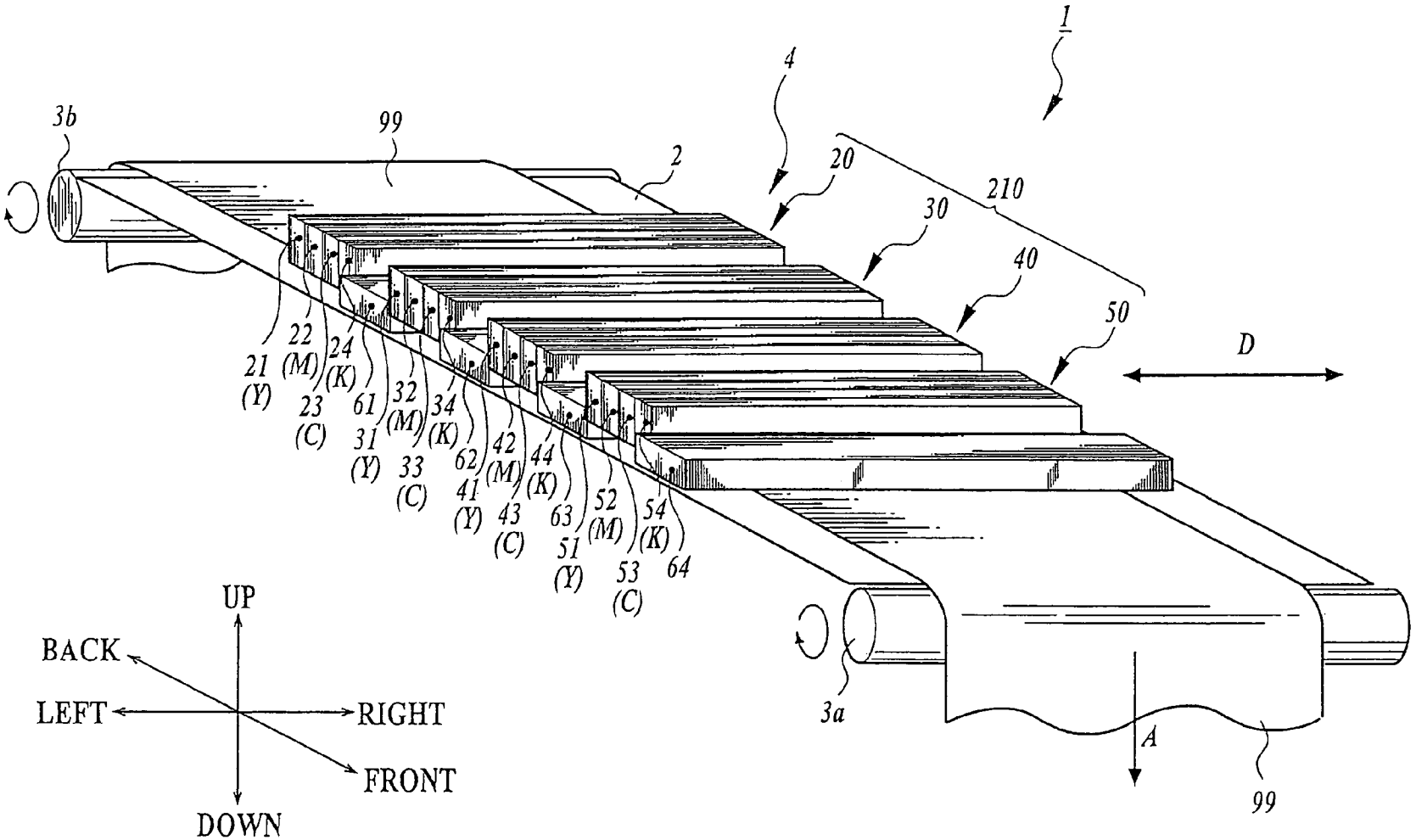
FIG. 6 is a perspective view showing a rough structure of an inkjet printer according to a second embodiment.

FIG. 6 is a perspective view showing a rough structure of the inkjet printer 1.

As shown in FIG. 6, a recording heads unit 210 is placed above the platen 2. The recording heads unit 210 comprises four heads groups, which are a first heads group 20, a second heads group 30, a third heads group 40 and a fourth heads group 50. Each of the heads groups 20, 30, 40 and 50 is mutually united with a joining portion (not shown). Among the recording heads unit 210, from upstream to downstream along the conveyance direction A of the recording medium 99, the first heads group 20, the second heads group 30, the third heads group 40 and the fourth heads group 50 are placed in the mentioned order.

The first heads group 20 is composed of four line heads 21, 22, 23 and 24 for respectively jetting each process color ink of Y, M, C and K toward the recording surface of the recording medium 99. Similarly, the second heads group 30 is composed of four line heads 31, 32, 33 and 34, the third heads group 40 is composed of four line heads 41, 42, 43 and 44 and the fourth heads group 50 is composed of four line heads 51, 52, 53 and 54. Each of the line heads 21 to 24, 31 to 34, 41 to 44 and 51 to 54 is a recording head extending across approximately the whole width of the recording medium 99 along a direction D (hereafter, it is called "an perpendicular direction D") perpendicular to the conveyance direction A and is capable of jetting ink over approximately the whole width of the recording medium 99.

These line heads 21 to 24, 31 to 34, 41 to 44 and 51 to 54 are combined thereamong at each heads group. For example, in the first heads group 20, the four line heads 21 to 24 are combined among each of the line head 21 to 24 thereby, it is possible to prevent misalignment among each of the line heads at each heads group.

Further, as shown in FIG. 6, at the downstream side of each of the heads groups 20, 30, 40 and 50 along the conveyance direction A of the recording medium 99, ultraviolet irradiation units 61 to 64 are respectively placed as irradiation sections extending across approximately the whole width of the recording medium. In each of the ultraviolet irradiation units 61 to 64, ultraviolet rays-sources (not shown) are respectively placed, and it is possible to irradiate ultraviolet rays toward the recording surface of the recording medium 99 respectively by turning the ultraviolet rays sources on. As the ultraviolet rays source, a high-pressure mercury lamp, a metal halide lamp, a black light, a cold-cathode tube, an LED (Light Emitting Diode) or the like can be applied.

Figure 7:
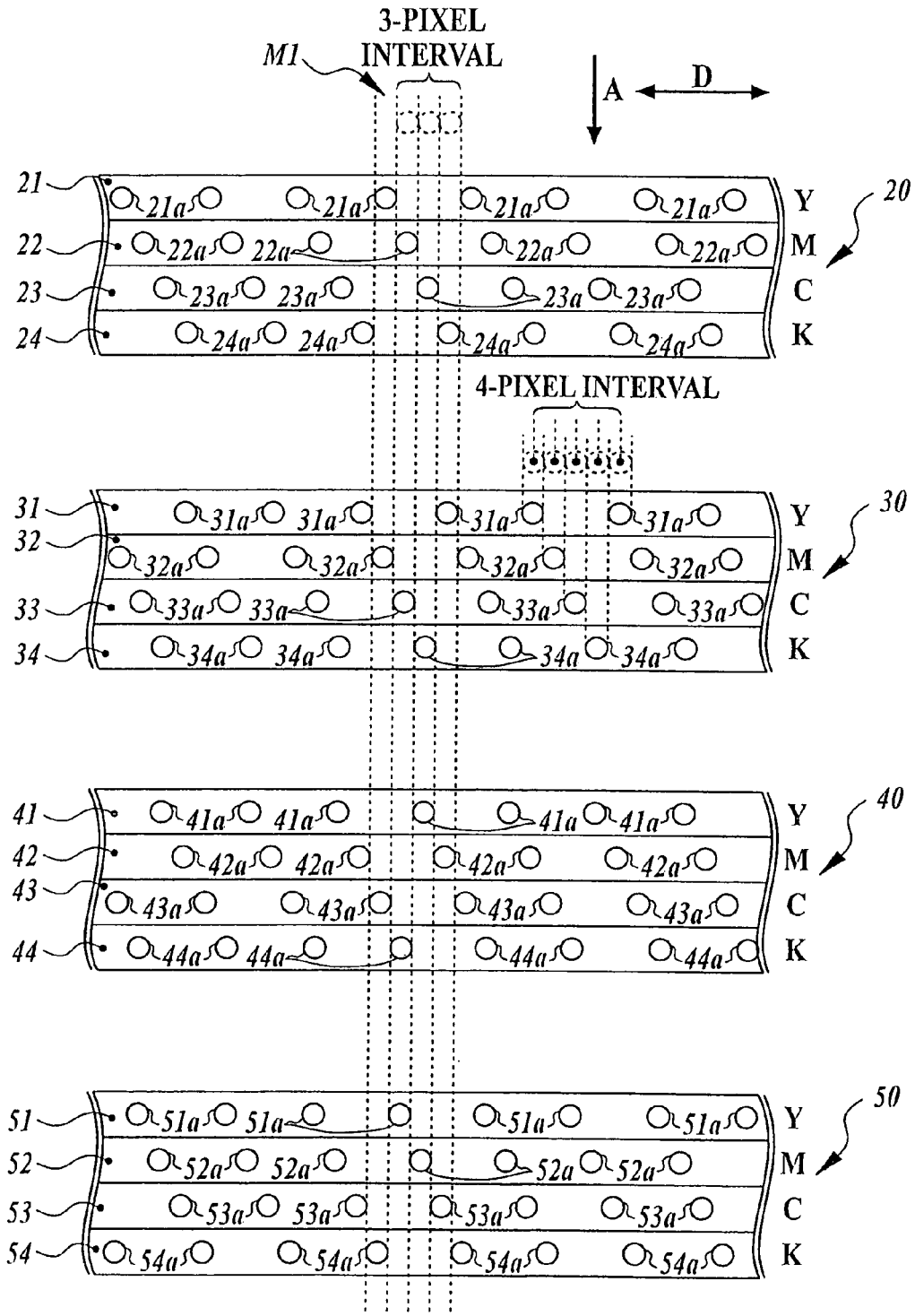
FIG. 7 is a plan view showing nozzle placement among each line head.

FIG. 7 is a magnified plan view showing a part of under surfaces (surfaces opposed to the platen 2) of the line heads 21 to 24, 31 to 34, 41 to 44 and 51 to 54 of each of the heads groups 20, 30, 40 and 50 shown in FIG. 6.

In the case of focusing on one heads group, the first heads group 20 among the four heads groups 20, 30, 40 and 50, as shown in FIG. 7, on the under surfaces of the line heads 21 to 24, a plurality of nozzles 21*a*, 21*a*, 24*a*, 24*a*, . . . are placed at each of the line heads 21 to 24. Each of the nozzles 21*a* to 24*a* is a jetting gate for jetting ink of colors corresponding to the line heads 21 to 24 as minute liquid drops.

The plurality of nozzles 21*a*, 21*a*, . . . are arrayed in-line along the perpendicular direction D and an interval as much as three pixels is secured therebetween. The nozzles 22*a*, 23*a* and 24*a* arrayed in the same way.

Then, the nozzle 22*a* is placed with one pixel shifted from the nozzle 21*a* to the right in FIG. 7 along the perpendicular direction D, the nozzle 23*a* is placed with one pixel shifted from the nozzle 22*a* to the right in FIG. 7 along the perpendicular direction D and the nozzle 24*a* is placed with one pixel shifted from the nozzle 23*a* to the right in FIG. 7 along the perpendicular direction D. In other words, the nozzles 22*a*, 23*a* and 24*a* are disposed within the three-pixel intervals between each nozzle 21*a* with one pixel by one pixel shifted to the right in FIG. 7 in the mentioned order along the perpendicular direction D.

Among each of the line heads 21 to 24 having such nozzle placement, on each line along the conveyance direction A (vertical columns divided by dotted lines in FIG. 7), only one among the nozzles 21*a*, 22*a*, 23*a* and 24*a* exists respectively. Conversely, on the same column, two or more nozzles for jetting different colors from each other do not exist together.

In the explanation above, the first heads group, which is one among the four heads groups 20, 30, 40 and 50 is focused on. Similarly, each of the heads groups, the second heads group 30, the third heads group 40 and the fourth heads group 50, has approximately the same nozzle placement as the first heads group 20. In other words, the nozzles 32*a*, 42*a* and 52*a* for jetting ink M, the nozzles 33*a*, 43*a* and 53*a* for jetting ink C and the nozzles 34*a*, 44*a* and 54*a* for jetting ink K are respectively arranged with one pixel shifted from the nozzles 31*a*, 41*a* and 51*a* for jetting ink Y to the right in FIG. 7 in the mentioned order along the perpendicular direction D. However, in the second heads group 30, the nozzle 31*a* of the line head 31 is set to be placed on the same line as the nozzle 24*a* of the line head 24 in the first heads group 20. Similarly, in the third heads group 40, the nozzle 41*a* of the line head 41 is set to be placed on the same line as the nozzle 34*a* of the line head 34 in the second heads group 30, and in the fourth heads group 50, the nozzle 51*a* of the line head 51 is set to be placed on the same line as the nozzle 44*a* of the line head 44 in the third heads group 40.

Then, among each of the heads groups 20, 30, 40 and 50 having such nozzle placement, on each line along the conveyance direction A, one nozzle of a line head from each of the heads groups 20, 30, 40 and 50 exists and therefore four nozzles exist in total. Then, the nozzles existing on the same line are nozzles for jetting ink having different colors of Y, M, C and K from each other. For example, on a line M1 shown in FIG. 7, from upstream to downstream along the conveyance direction A, the nozzle 21*a* of the line head 21, the nozzle 32*a* of the line head 32, the nozzle 43*a* of the line head 43 and the nozzle 54*a* of the line head 54 exist in the mentioned order.

Incidentally, the description above says that there is an interval as much as three pixels secured between each of the nozzles 21*a* to 24*a*, 31*a* to 34*a*, 41*a* to 44*a* and 51*a* to 54*a* at each of the line heads 21 to 24, 31 to 34, 41 to 44 and 51 to 54 (refer to FIG. 7). However, to be precise, since the line heads 21 to 24, 31 to 34, 41 to 44 and 51 to 54 jet ink from center parts of the nozzles 21*a* to 24*a*, 31*a* to 34*a*, 41*a* to 44*a* and 51*a* to 54*a*, there is an interval as much as four pixels secured between each of the center parts of the nozzles 21*a* to 24*a*, 31*a* to 34*a*, 41*a* to 44*a* and 51*a* to 54*a* at each of the line heads 21 to 24, 31 to 34, 41 to 44 and 51 to 54.

Next, operation of the inkjet printer 1 in the second embodiment will be explained.

Before image recording operation, the recording medium 99 hangs between each of the conveyance rollers 3*a* and 3*b* while the non-recording surface thereof is supported by the platen 2.

Then, when the image recording operation starts, conveyance motors connected to the conveyance rollers 3*a* and 3*b* are respectively driven to rotate. Thereby, the recording medium 99 is intermittently conveyed from back to forth along the conveyance direction A between the platen A and the image recording unit 4.

At the same time, the line heads 21 to 24, 31 to 34, 41 to 44 and 51 to 54 in the heads groups 20, 30, 40 and 50 respectively jet the ink toward the image recording area of the recording surface of the recording medium 99 as minute liquid drops and the ultraviolet irradiation units 61 to 64 are turned on. Then, whenever the recording medium 99 passes under each of the heads groups 20, 30, 40 and 50, each ink of Y, M, C and K lands on the image recording area of the recording medium 99. Immediately after that, ultraviolet rays are irradiated on the landed ink, and the ink is cured and fixated on the recording surface of the recording medium 99.

Thereafter, with the above-mentioned operation repeated in the inkjet printer 1, a image is sequentially recorded on the image recording area of the recording surface of the recording medium 99 which has passed between the platen 2 and the image recording unit 4.

Here, with reference to FIG. 8, ink colors jetted on each pixel within the image recording area and piling order thereof will be explained.

FIG. 8 is a chart compiling a line (column) location (upper part), ink colors jetted on each pixel corresponding to the line location at the upper part (middle part) and piling order of ink colors jetted on each pixel corresponding to the line location at the upper part (lower part). Here, the image recording area is composed of 2m lines, which are 1, 2, . . . , m−1, m, m+1, . . . , 2m−1, 2m (m is any positive integer).

While the image recording area passes under the first heads group 20, when the line (m) passes just under the nozzle 21*a* of the line head 21 (refer to a column M1 in FIG. 7), ink Y is jetted on each pixel of the line (m). At the same time, since the nozzles 22*a*, 23*a* and 24*a* are respectively placed with one pixel shifted from the nozzle 21*a*, 22*a* and 23*a* to the right in the mentioned nozzle order along the perpendicular direction D, ink M is jetted on each pixel of the line (m+1), ink C is jetted on each pixel of the line (m+2) and ink K is jetted on each pixel of the line (m+3).

Thereafter, while the image recording area passes under the second heads group 30, when the line (m) passes just under the nozzle 32*a* of the line head 32, ink M is jetted on each pixel of the line (m). At the same time, as shown in FIG. 7, since the nozzles 33*a*, 34*a* and 31*a* are respectively placed with one pixel shifted from the nozzle 32*a*, 33*a* and 34*a* to the right in the mentioned nozzle order along the perpendicular direction D, ink C is jetted on each pixel of the line (m+1), ink K is jetted on each pixel of the line (m+2) and ink Y is jetted on each pixel of the line (m+3).

Thereafter, while the image recording area passes under the third heads group 40, when the line (m) passes just under the nozzle 43*a* of the line head 43, ink C is jetted on each pixel of the line (m). At the same time, as shown in FIG. 7, since the nozzles 44*a*, 41*a* and 42*a* are respectively placed with one pixel shifted from the nozzle 43*a*, 44*a* and 41*a* to the right in the mentioned nozzle order along the perpendicular direction D, ink K is jetted on each pixel of the line (m+1), ink Y is jetted on each pixel of the line (m+2) and ink M is jetted on each pixel of the line (m+3).

Thereafter, while the image recording area passes under the fourth heads group 50, when the line (m) passes just under the nozzle 54*a* of the line head 54, ink K is jetted on each pixel of the line (m). At the same time, as shown in FIG. 7, since the nozzles 51*a*, 52*a* and 53*a* are respectively placed with one pixel shifted from the nozzle 54*a*, 51*a* and 52*a* to the right in the mentioned nozzle order along the perpendicular direction D, ink Y is jetted on each pixel of the line (m+1), ink M is jetted on each pixel of the line (m+2) and ink C is jetted on each pixel of the line (m+3).

Overall, by passing the image recording area of the recording medium 99 under the four heads groups 20, 30, 40 and 50, image recording on each of the 2m lines is completed. Here, as shown in FIG. 8, each ink color piles up in the order of Y→M→C→K on each pixel of the line (m), in the order of M→C→K→Y on each pixel of the line (m+1), in the order of C→K→Y→M on each pixel of the line (m+2) and in the order of K→Y→M→C on each pixel of the line (m+3). Further, even in the lines before the line (m) and after the line (m+3), a line where each ink color piles up in the order of Y→M→C→K, a line where each ink color piles up in the order of M→C→K→Y, a line where each ink color piles up in the order of C→K→Y→M and a line where each ink color piles up in the order of K→Y→M→C repeatedly line up in the mentioned line order with a cycle of the four lines (m), (m+1), (m+2) and (m+3) continued.

In other words, in the image recording area composed of the 2m lines, the line where each color ink piles up in the order of Y→M→C→K, the line where each color ink piles up in the order of M→C→K→Y, the line where each color ink piles up in the order of C→K→Y→M, and the line where each color ink piles up in the order of K→Y→M→C are respectively repeated at every four lines.

In the above-mentioned inkjet printer 1 in the second embodiment, each ink color piles up in one of the above-mentioned four orders for forming each line of the image recording area, and lines located next to each other have different ink color piling order. Accordingly, between each line, pixels having different ink piling order are located next to each other. Thereby, by having an easy structure of nozzle placement where each of the heads groups 20, 30, 40 and 50 are respectively shifted in an extending direction of the line head and nozzles in one line head are arranged on the same lines as nozzles in the other line heads among each of the heads groups 20, 30, 40 and 50, it is possible to locate pixels having different ink color piling order next to each other. Consequently, it is possible to inhibit color tone change on a recording-finished image.

Further, in the second embodiment, since the line heads 21 to 24, 31 to 34, 41 to 44 and 51 to 54 are combined with each other at each heads group, misalignment of the nozzles among the line heads at each heads group does not happen. Consequently, it is possible to equalize distance among each dot formed on the image recording area of the recording medium 99, and thereby it is possible to prevent from each dot unevenly positioning in the image recording area.

Next, with reference to FIG. 9, an alternative of the image recording unit 4 instead of that of FIG. 6 will be explained.

Figure 9:
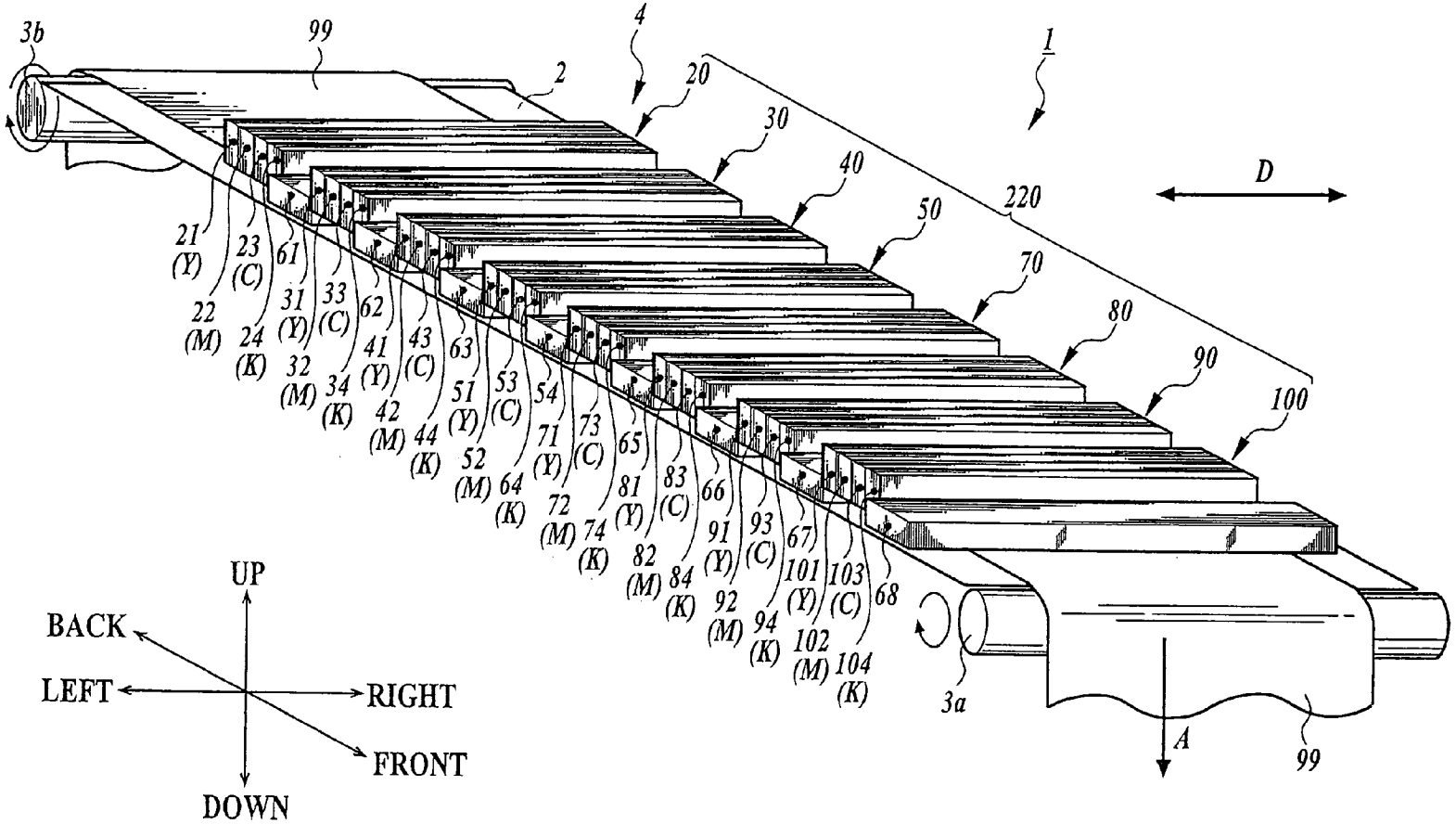
FIG. 9 is a perspective view showing an alternative of the image recording unit shown in FIG. 6.

FIG. 9 is a view showing an alternative of the image recording unit 4 shown in FIG. 6, and a perspective view showing a rough structure of the inkjet printer 1 including the alternative image recording unit 4.

As shown in FIG. 9, a recording heads unit 220 is placed above the platen 2. The recording heads unit 220 is composed of the above-mentioned first heads group 20 to fourth heads group 50, and a fifth heads group 70, a sixth heads group 80, a seventh heads group 90 and a eighth heads group 100. Each of the heads groups 20, 30, 40, 50, 70, 80, 90 and 100 is mutually combined with a joining portion (not shown). In the recording heads unit 220, from upstream to downstream along the conveyance direction A of the recording medium 99, the above-mentioned first heads group 20 to fourth heads group 50 are placed, and further the fifth heads group 70, the sixth heads group 80, the seventh heads group 90 and the eighth heads group 100 are also placed in the mentioned heads group order.

The fifth heads group 70 to the eighth heads group 100, as well as the above-mentioned first heads group 20 to fourth heads group 50, respectively comprise four line heads 71 to 74, 81 to 84, 91 to 94 and 101 to 104 for jetting ink of each process color Y, M, C and K, toward the recording surface of the recording medium 99. Each of the line heads 71 to 74, 81 to 84, 91 to 94 and 101 to 104, as well as each of the above-mentioned line heads 21 to 24, 31 to 34, 41 to 44 and 51 to 54, is a recording head extending along the perpendicular direction D across approximately the whole width of the recording medium 99, and jets ink over approximately the whole width of the recording medium 99.

Then, the line heads 71 to 74, 81 to 84, 91 to 94 and 101 to 104, as well as the line heads 21 to 24, 31 to 34, 41 to 44 and 51 to 54, are respectively combined thereamong at each heads group. For example, in the fifth heads group 70, the four line heads 71 to 74 are combined among each of the four line heads 71 to 74. Thereby, it is possible to prevent misalignment among the line heads at each heads group.

Further, as shown in FIG. 9, at the downstream side of each of the heads groups 70, 80, 90 and 100 along the conveyance direction A of the recording medium 99, ultraviolet irradiation units 65 to 68 as light irradiation sections extending across approximately the whole width of the recording medium 99 are respectively placed. The ultraviolet irradiation units 65 to 68, as well as the above-mentioned ultraviolet irradiation units 61 to 64, respectively comprise ultraviolet rays sources (not shown) for irradiating ultraviolet rays, and the ultraviolet irradiation units 65 to 68 are capable of irradiating ultraviolet rays toward the recording surface of the recording medium 99 by turning the ultraviolet rays sources on. As the ultraviolet rays source, a high-pressure mercury lamp, a metal halide lamp, a black light, a cold-cathode tube, an LED (Light Emitting Diode) or the like can be applied.

Figure 10:
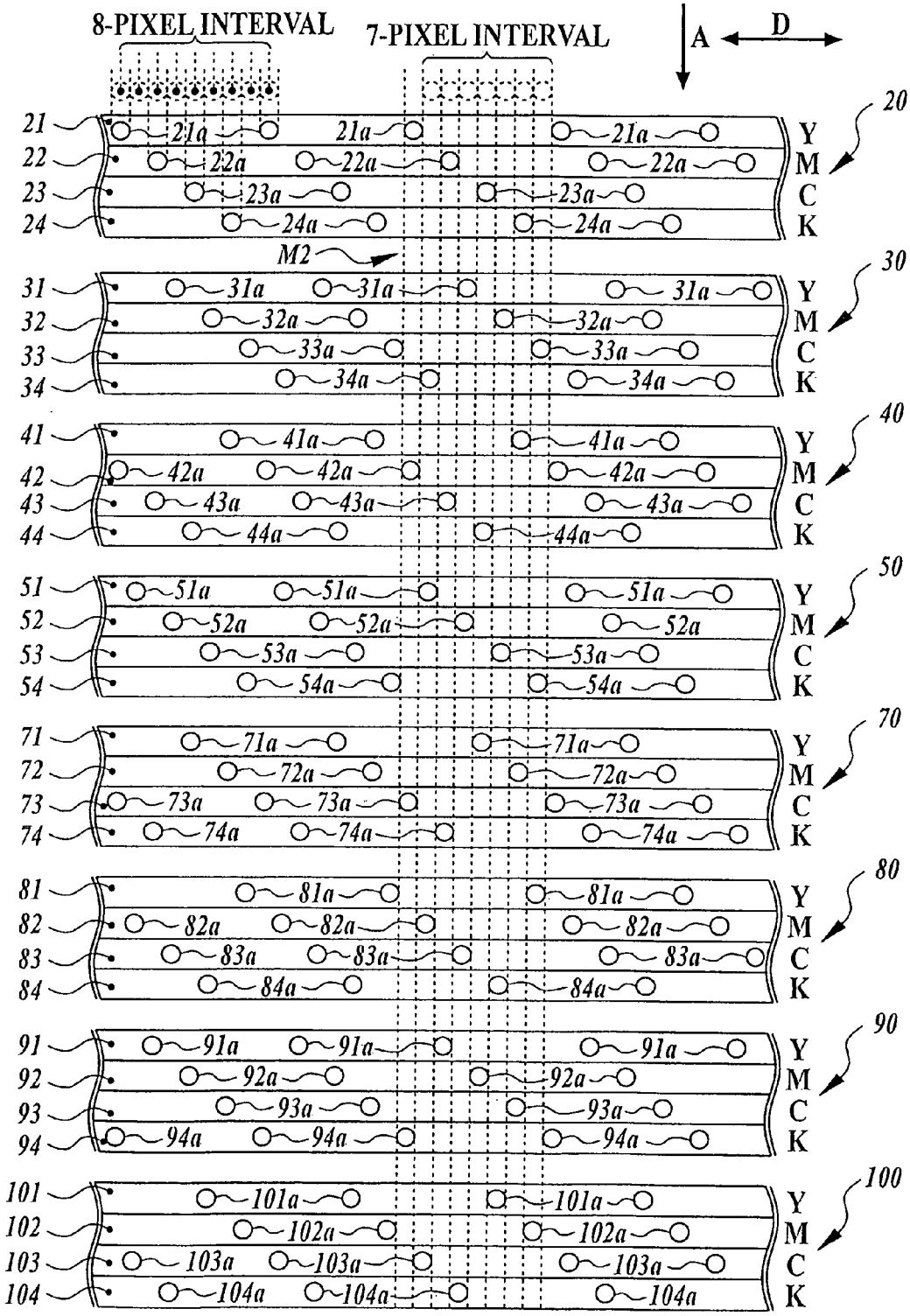
FIG. 10 is a plan view showing nozzle placement among each line head of the image recording unit shown in FIG. 9.

FIG. 10 is a magnified plan view showing a part of under surfaces (surfaces opposed to the platen 2) of the line heads 21 to 24, 31 to 34, 41 to 44, 51 to 54, 71 to 74, 81 to 84, 91 to 94 and 101 to 104 of the heads groups 20, 30, 40, 50, 70, 80, 90 and 100.

As well as the case where the nozzle placement of each of the heads groups 20, 30, 40 and 50 shown in FIG. 7 is explained, in the case of focusing on one heads group, the first heads group 20 among the eight heads groups 20, 30, 40, 50, 70, 80, 90 and 100, as shown in FIG. 10, a plurality of nozzles 21*a*, 21*a*, . . . , 24*a*, 24*a*, . . . are arrayed in-line at each of the line heads 21 to 24 along the perpendicular direction D.

Then, an interval as much as seven pixels is secured between each nozzle 21*a* of the line head 21. Similarly, an interval as much as seven pixels is secured between each of the other nozzles 22*a*, 23*a* and 24*a*.

Further, the nozzle 22*a* is placed with two pixels shifted from the nozzle 21*a* to the right in FIG. 10 along the perpendicular direction D, the nozzle 23*a* is placed with two pixels shifted from the nozzle 22*a* to the right in FIG. 10 along the perpendicular direction D, and the nozzle 24*a* is placed with two pixels shifted form the nozzle 23*a* to the right in FIG. 10 along the perpendicular direction D. In other words, within the seven-pixel interval between each nozzle 21*a*, the nozzles 22*a*, 23*a* and 24*a* are disposed with two pixels shifted respectively from the nozzles 21*a*, 22*a* and 23*a* to the right in FIG. 10 in the mentioned nozzle order, along the perpendicular direction D.

Among each of the line heads 21 to 24 having such nozzle placement, on each line along the conveyance direction A, either a line where only one among the nozzles 21*a*, 22*a*, 23*a* and 24*a* exists or a line where no nozzle exists, and the line with a nozzle and the line without a nozzle alternately line up.

In the explanation above, the first heads group, which is one among the eight heads groups, the first heads group 20 to the eighth heads group 100, is focused on. Similarly, each heads group of the second heads group 30 to the eighth heads group 100 has approximately the same nozzle placement as that of the first heads group. In other words, the nozzles 32*a*, 42*a*, 52*a*, 72*a*, 82*a*, 92*a* and 102*a* for jetting ink M, the nozzles 33*a*, 43*a*, 53*a*, 73*a*, 83*a*, 93*a* and 103*a* for jetting ink C and the nozzles 34*a*, 44*a*, 54*a*, 74*a*, 84*a*, 94*a* and 104*a* for jetting ink K are respectively arranged at positions shifted two pixels by two pixel from the nozzles 31*a*, 41*a*, 51*a*, 71*a*, 81*a*, 91*a* and 101*a* for jetting ink Y to the right in FIG. 10 in the mentioned nozzle order along the perpendicular direction D. However, in the second heads group 30, the nozzle 31*a* of the line head 31 is set to be placed on a line between the nozzle 22*a* of the line head 22 and the nozzle 23*a* of the line head 23 in the first heads group 20 along the perpendicular direction D. Similarly, in each of the third heads group 40 to the eighth heads group 100, a nozzle for jetting ink Y in a heads group is set to be placed between a nozzle for jetting ink M and a nozzle for jetting ink C in a heads group which is located one-step upstream along the conveyance direction A than the heads group having the nozzle of ink Y.

Then, among each of the heads groups 20, 30, 40, 50, 70, 80, 90 and 100 having such nozzle placement, on each line along the conveyance direction A, a line where there are four nozzles which are respectively the ones from each of the heads groups 20, 40, 70 and 90, and a line where there are four nozzles which are respectively the ones from each of the heads groups 30, 50, 80 and 100 exist and alternately line up. Here, the nozzles existing on the same line jet ink having different colors of Y, M, C and K from each other. For example, on the line M2 shown in FIG. 10, from upstream to downstream along the conveyance direction A, the nozzle 21*a* of the line head 21, the nozzle 42*a* of the line head 42, the nozzle 73*a* of the line head 73 and the nozzle 94*a* of the line head 94 exist in the mentioned nozzle order.

Incidentally, the description above says that there is an interval as much as seven pixels secured between each of the nozzles 21*a* to 24*a*, 31*a* to 34*a*, 41*a* to 44*a*, 51*a* to 54*a*, 71*a* to 74*a*, 81*a* to 84*a*, 91*a* to 94*a* and 101*a* to 104*a* at each of the line heads 21 to 24, 31 to 34, 41 to 44, 51 to 54, 71 to 74, 81 to 84, 91 to 94 and 101 to 104 (refer to FIG. 10). However, to be precise, since the line heads 21 to 24, 31 to 34, 41 to 44, 51 to 54, 71 to 74, 81 to 84, 91 to 94 and 101 to 104 jet ink from center parts of the nozzles 21*a* to 24*a*, 31*a* to 34*a*, 41*a* to 44*a*, 51*a* to 54*a*, 71*a* to 74*a*, 81*a* to 84*a*, 91*a* to 94*a* and 101*a* to 104*a*, there is an interval as much as eight pixels secured between each of the center parts of the nozzles 21*a* to 24*a*, 31*a* to 34*a*, 41*a* to 44*a*, 51*a* to 54*a*, 71*a* to 74*a*, 81*a* to 84*a*, 91*a* to 94*a* and 101*a* to 104*a* at each of the line heads 21 to 24, 31 to 34, 41 to 44, 51 to 54, 71 to 74, 81 to 84, 91 to 94 and 101 to 104.

Then, in the case of using the image recording unit 4 of FIG. 9 instead of that of FIG. 6, in the same way as mentioned above, in the inkjet printer 1, the recording medium 99 is intermittently conveyed, and in this state, while the line heads of the first heads group 20 to the eighth heads group 100 jet ink from each nozzle, the ultraviolet rays sources of each of the ultraviolet irradiation units 61 to 68 are turned on and images are recorded on the image recording area of the recording medium 99.

Here, with reference to FIG. 11, in the case of using the image recording unit 4 of FIG. 9 instead of that of FIG. 6, ink colors jetted on each pixel within the image recording area and piling order thereof will be explained.

FIG. 11, approximately the same as FIG. 8, is a chart compiling a line (column) location in the image recording area of the recording medium 99 (upper part), an ink color jetted on each pixel of a line corresponding to the line location at the upper part (middle part) and piling order of ink color jetted on each pixel of the line corresponding to the line location at the upper part (lower part).

While the image recording area passes under the first heads group 20, when the line (m) passes just under the nozzle 21*a* of the line head 21 (refer to the line M2 shown in FIG. 10), ink Y is jetted on each pixel of the line (m). At the same time, as shown in FIG. 10, since the nozzles 22*a*, 23*a* and 24*a* are respectively placed with two pixels shifted from the nozzle 21*a*, 22*a* and 23*a* to the right in the mentioned nozzle order along the perpendicular direction D, ink M is jetted on each pixel of the line (m+2), ink C is jetted on each pixel of the line (m+4), ink K is jetted on each pixel of the line (m+6) and no ink is jetted on each pixel of the lines (m+1), (m+3), (m+5) and (m+7).

Thereafter, while the image recording area passes under the second heads group 30, when the line (m+1) passes just under the nozzle 34*a* of the line head 34, ink K is jetted on each pixel of the line (m+1). At the same time, as shown in FIG. 10, since the nozzles 31*a*, 32*a* and 33*a* are respectively placed with two pixels shifted from the nozzle 34*a*, 31*a* and 32*a* to the right in the mentioned nozzle order along the perpendicular direction D, ink Y is jetted on each pixel of the line (m+3), ink M is jetted on each pixel of the line (m+5), ink C is jetted on each pixel of the line (m+7) and no ink is jetted on each pixel of the lines (m+2), (m+4) and (m+6). Moreover, since the nozzle does not pass above the line (m), no ink is jetted on each pixel of the line (m), either.

Thereafter, as well as the case where the image recording area of the recording medium 99 passes either the first heads group 20 or the second heads group 30, the image recording area passes under the third heads group 40 to the eighth heads group 100 sequentially, and image recording on each of the lines (m) to (m+7) is completed. Here, as shown in FIG. 11, each color ink piles up in the order of Y→M→C→K on each pixel of the lines (m) and (m+3), in the order or K→Y→M→C on each pixel of the lines (m+1) and (m+6), in the order M→C→K→Y on each pixel of the lines (m+2) and (m+5) and in the order of C→K→Y→M on each pixel of the lines (m+4) and (m+7). Further, by passing the image recording area under the first heads group 20 to the eighth heads group 100, even before the line (m) and after the line (m+7), a line where each ink color piles up in the order of Y→M→C→K, a line where each ink color piles up in the order of K→Y→M→C, a line where each ink color piles up in the order of M→C→K→Y and a line where each ink color piles up in the order of C→K→Y→M repeatedly line up with a cycle of the color piling order of each of the lines from (m) to (m+7) continued.

As mentioned, in the case of using the image recording unit 4 of FIG. 9 instead of that of FIG. 6, each ink color of Y, M, C and K piles up in any one of the above-mentioned four orders for forming each line of the image recording area, and lines located next to each other have different ink color piling order. Accordingly, between each line, pixels having different ink color piling order are located next to each other. Thereby, by having an easy structure of nozzle placement where each of the heads groups 20, 30, 40 and 50 are respectively shifted in an extending direction of the line heads and nozzles in one line head are arranged on the same line as nozzles in the other line heads among each of the heads groups 20, 30, 40 and 50, it is possible to locate pixels having different ink color piling order next to each other. Consequently, it is possible to inhibit color tone change on a recording-finished image.

Further, in the case of using the image recording unit 4 of FIG. 9 instead of that of FIG. 6, in each of the heads groups 20, 30, 40, 50, 70, 80, 90 and 100, each of the nozzles of the three line heads for jetting ink M, C and K are respectively arranged at a position shifted two pixels by two pixel from each of the nozzles for jetting ink Y to the right in FIG. 10 in the mentioned nozzle order along the perpendicular direction D. Therefore, whenever the recording medium 99 passes under each of the heads groups 20, 30, 40, 50, 70, 80, 90 and 100, a line made of dots of each color, Y, M, C and K is formed at every two lines. Accordingly in this case, since an interval as much as one pixel is secured between lines located next to each other, it is possible to prevent from blending ink between each dot formed on the image recording area, and thereby it is possible to improve image quality on a recording-finished image.

In addition, in the second embodiment, the example where either the first heads group 20 to the fourth heads group 50 or the first heads group 20 to the eighth heads group 100 are arrayed in-line in the mentioned heads group order along the conveyance direction A, is explained. However, the order of each heads group may be changed, the order of the line heads among each of the heads groups may be changed without changing the order of each heads group, or both the order of each heads group and line heads of each heads group may be changed.

Further, in the image recording unit 4 of the second embodiment shown in FIG. 6, the ultraviolet irradiation units 61 to 64 are respectively placed at the downstream side of the heads groups 20, 30, 40 and 50 along the conveyance direction A of the recording medium 99. However, at least one of the four ultraviolet irradiation units 61 to 64 may be placed, and preferably the ultraviolet irradiation unit 64, which is located the most downstream along the conveyance direction A, among the four ultraviolet irradiation units 61 to 64 is at least placed. Further, similarly, in the image recording unit 4 shown in FIG. 9, the ultraviolet irradiation units 61 to 68 are respectively placed at the downstream side of the heads groups 20, 30, 40, 50, 70, 80, 90 and 100 along the conveyance direction A of the recording medium 99. However, at least one of the eight ultraviolet irradiation units 61 to 68 may be placed, and preferably the ultraviolet irradiation unit 68, which is located the most downstream along the conveyance direction A, among the eight ultraviolet irradiation units 61 to 68 is at least placed.

In addition, the present invention is not limited to the structure of the first embodiment or the second embodiment, and may be changed or modified without departing essence thereof.

For example, in the first or second embodiment as mentioned above, as ink applicable to the present invention, photo-curing type ink capable of being cured with ultraviolet ray irradiation, is illustrated. However, the applicable ink is not necessarily limited to the photo-curing type ink, and ink used in the above-mentioned first or second embodiment may be ink capable of being cured with irradiation of light other than ultraviolet rays. Here, the "light" means light in broad sense, including electromagnetic wave such as ultraviolet rays, electron beam, X-ray, visible light, infrared rays and the like. In other words, as the ink used in the first or the second embodiment, polymerized compound, which is capable of being polymerized and photo-cured by light other than ultraviolet rays and photoinitiator, which starts polymerizing photoreaction of polymerized compounds with light other than ultraviolet rays may be applied. If the photo-curing type ink capable of being cured by light other than ultraviolet rays is used, instead of the ultraviolet rays irradiation units 9 and 10 shown in FIG. 1 or the ultraviolet rays irradiation units 61 to 68 shown in FIG. 6 and FIG. 9, a light source irradiating the light other than ultraviolet rays has to be applied.

Further, the ink used in the first or the second embodiment is not limited to the above-mentioned photo-curing type ink, it may be ink capable of being cured with heat caused by irradiation of the above-mentioned light (including electromagnetic wave such as ultraviolet rays, electron beam, X-ray, visible light, infrared rays and the like). In this case, it is possible to apply normal ink for use of inkjet printers, ink capable of being dried and cured with heat. Consequently, it is possible to improve versatility of ink used in the first or the second embodiment.

While the preferred embodiments of the present invention have been described using specific terms, such description is for illustrative purposes only, and it is to be understood that changes and variations may be made without departing from the spirit or scope of the appended claims.

What is claimed is:

1. An inkjet printer comprising:

a recording head for jetting a black ink, a recording head for jetting a cyan ink, a recording head for jetting a magenta ink, and a recording head for jetting a yellow ink, wherein an image is recorded on a recording medium by forming a plurality of lines by moving the recording heads which jet the black ink, the cyan ink, the magenta ink, and the yellow ink, respectively, over the recording medium that is conveyed along a conveyance direction, along a direction perpendicular to the conveyance direction;

each of the recording heads comprises a plurality of nozzles for jetting the ink as minute liquid drops;

the plurality of nozzles are arrayed at intervals of predetermined number of pixels along the conveyance direction in each of the recording heads;

each nozzle of one recording head is arranged at a position shifted from each nozzle of the other recording head along the conveyance direction of the recording medium so as to dispose each nozzle of the one recording head within the interval of the predetennined number of pixels between the nozzles of the other recording head, and the plurality of nozzles are arranged such that, in the plurality of lines, ink color piling orders of pixels between adjacent lines are different from each other.

2. The printer of claim 1, wherein the plurality of nozzles are arrayed at intervals of three pixels; and each nozzle of three recording heads is arranged at a position shifted one pixel by one pixel from each nozzle of the other one recording head along the conveyance direction of the recording medium so as to dispose each nozzle of the three recording heads within the interval of three pixels between the nozzles of the other one recording head.

3. The printer of claim 1, wherein the plurality of nozzles are arrayed at intervals of seven pixels; and each nozzle of three recording heads is arranged at a position shifted two pixels by two pixels from each nozzle of the other one recording head along the conveyance direction of the recording medium so as to dispose each nozzle of the three recording heads within the interval of seven pixels between the nozzles of the other one recording head.

4. The printer of claim 1, wherein the recording heads are combined with each other.

5. The printer of claim 1 further comprising:

light irradiation sections for irradiating light toward the recording medium; and a carriage capable of moving along the direction perpendicular to the conveyance direction, wherein the ink is capable of being cured by the light irradiated or heat caused by the light irradiated;

the carriage comprises the recording heads and the light irradiation sections; and the light irradiation sections are placed at two locations apart from each other along the direction perpendicular to the conveyance direction, and the recording heads are placed between the light irradiation sections.

6. A recording heads unit comprising:

a recording head for jetting a black ink, a recording head for jetting a cyan ink, a recording head for jetting a magenta ink, and a recording head for jetting a yellow ink, wherein an image is recorded on a recording medium by forming a plurality of lines by moving the recording heads which jet the black ink, the cyan ink, the magenta ink, and the yellow ink, respectively, over the recording medium that is conveyed along a conveyance direction, along a direction perpendicular to the conveyance direction;

each of the recording heads comprises a plurality of nozzles for jetting the ink as minute liquid drops;

the plurality of nozzles are arrayed at intervals of predetermined number of pixels along the conveyance direction in each of the recording heads;

each nozzle of one recording head is arranged at a position shifted from each nozzle of the other recording head along the conveyance direction of the recording medium so as to dispose each nozzle of the one recording head within the interval of the predetermined number of pixels between the nozzle of the other recording head, and the plurality of nozzles are arranged such that, in the plurality of lines, ink color piling orders of pixels between adjacent lines are different from each other.

7. The unit of claim 6, the plurality of nozzle are arrayed at intervals of three pixels; and each nozzle of three recording heads is arranged at a position shifted one pixel by one pixel from each nozzle of the other one recording head along the conveyance direction of the recording medium so as to dispose each nozzle of the three recording heads within the interval of three pixels between the nozzle of the other one recording head.

8. The unit of claim 6, the plurality of nozzles are arrayed at intervals of seven pixels; and each nozzle of three recording heads is arranged at a position shifted two pixels by two pixels from each nozzle of the other one recording head along the conveyance direction of the recording medium so as to dispose each nozzle of the three recording heads within the interval of seven pixels between the nozzles of the other one recording head.

9. The unit of claim 6, wherein the recording heads are combined with each other.

* * * * *